US012220041B2

(12) United States Patent
Kim et al.

(10) Patent No.: US 12,220,041 B2
(45) Date of Patent: Feb. 11, 2025

(54) ONE-HAND LIPSTICK CONTAINER, METHOD OF PRODUCING THE SAME, AND INTERNAL ASSEMBLY FOR ONE-HAND LIPSTICK CONTAINER

(71) Applicant: Catscara Inc., Brooklyn, NY (US)

(72) Inventors: Asher T. Kim, Brooklyn, NY (US); Aiden T. Kim, Brooklyn, NY (US)

(73) Assignee: Catscara Inc., Brooklyn, NY (US)

( * ) Notice: Subject to any disclaimer, the term of this patent is extended or adjusted under 35 U.S.C. 154(b) by 123 days.

(21) Appl. No.: 17/692,366

(22) Filed: Mar. 11, 2022

(65) Prior Publication Data

US 2023/0284766 A1 Sep. 14, 2023

(51) Int. Cl.
*A45D 40/06* (2006.01)

(52) U.S. Cl.
CPC ..... *A45D 40/065* (2013.01)

(58) Field of Classification Search
CPC ..... A45D 40/023; A45D 40/065
See application file for complete search history.

(56) References Cited

U.S. PATENT DOCUMENTS

| | | | |
|---|---|---|---|
| 2,386,417 | A | 10/1945 | Apfelbaum |
| 2,486,073 | A | 10/1949 | Sommer |
| 2,513,830 | A | 7/1950 | Voegeli |
| 2,644,577 | A | 7/1953 | Orenick |
| 3,612,072 | A | 10/1971 | Fukui |
| 3,617,138 | A | 11/1971 | Fukui |
| 4,973,178 | A | 11/1990 | Kakuta et al. |
| 5,037,227 | A | 8/1991 | Kakuta et al. |
| 5,171,096 | A | 12/1992 | Perrotti |
| 5,423,622 | A | 6/1995 | Perrotti |

(Continued)

FOREIGN PATENT DOCUMENTS

| | | | |
|---|---|---|---|
| KR | 101430902 | B1 | 9/2014 |
| KR | 20160065605 | A | 6/2016 |
| WO | 2011/002265 | A2 | 1/2011 |

OTHER PUBLICATIONS

Lee, machine translation of KR 10-2016-0065605-A, 2016 (Year: 2016).*

(Continued)

*Primary Examiner* — David P Angwin
*Assistant Examiner* — Bradley S Oliver
(74) *Attorney, Agent, or Firm* — WHDA, LLP

(57) ABSTRACT

A one-hand lipstick container includes a cylindrical main body extending in axial direction; a cover holder rotatably received on an outer circumferential surface of the cylindrical main body via a first screw mechanism therebetween; a cover hinged to the cover holder to open and close an opening at an upper end of the one-hand lipstick container; a lipstick housing rotatably received on an inner circumferential surface of the cylindrical main body via a second screw mechanism therebetween, an intermediate member interposed radially between the cylindrical main body and the lipstick housing, the intermediate member including a head and a guide sleeve extending from the head, an upper case affixed to the intermediate member; a bottom case affixed to the cylindrical main body; and a cover guide attached to the head of the intermediate member, the cover guide including a cover guide groove along which the cover is guided.

15 Claims, 35 Drawing Sheets

(56) References Cited

U.S. PATENT DOCUMENTS

| | | | |
|---|---|---|---|
| 5,890,826 | A | 4/1999 | Kim |
| 5,904,431 | A | 5/1999 | Terruzzi |
| 5,979,468 | A | 11/1999 | Blake, III |
| 6,056,465 | A | 5/2000 | Kuo |
| 6,588,959 | B1 | 7/2003 | Kuo |
| 2011/0070012 | A1 | 3/2011 | Kim et al. |
| 2012/0099916 | A1 | 4/2012 | Kim |
| 2016/0249729 | A1 | 9/2016 | Hermouet et al. |

OTHER PUBLICATIONS

International Search Report dated Jun. 23, 2023, issued in counterpart International application No. PCT/IB 23/51909. (2 pages).
Written Opinion dated Jun. 23, 2023, issued in counterpart International application No. PCT/IB 23/51909. (7 pages).

* cited by examiner

ONE-HAND LIPSTICK CONTAINER, METHOD OF PRODUCING THE SAME, AND INTERNAL ASSEMBLY FOR ONE-HAND LIPSTICK CONTAINER

BACKGROUND OF THE INVENTION

Technical Field

The present disclosure relates to a lipstick container, and more specifically, to a one-hand lipstick container that can be used by one hand.

Description of Related Art

In general, lipsticks are necessities that most women carry. Although most women put on a lipstick in the house to go outside, they put on a lipstick at the outside also in many cases. Therefore, lipsticks should be easy to carry and use.

Containers for the lipsticks are formed such that a container main body and a container cover are separated, such that users had to use the lipstick with one hand while holding the container cover with other hand.

The structure of existing lipstick containers known in the art is described below.

Lipstick containers are composed of a cylinder with a vertical groove standing in a container main body, a lipstick holder inserted in the container main body, an outer container surrounding the outer side of the cylinder in the container main body, and a cover have been widely known.

The lipstick containers in the relate art have the advantage of being beautiful because there is no protrusion in the containers receiving a lipstick, and giving an elegant impression because of using rotational motion, and reducing manufacturing cost and time because the number of parts is small; however, users have to use both hands to open the case and turn the lower portion of the containers.

Further, the lipstick containers in the related art have a problem in that the lipstick is mashed and cannot be used, when the cover is closed, with the lipstick not fully inserted in the container.

Researches for developing a lipstick container that can be used by one hand have been conducted to increase portability and convenience of the lipstick container. As a related art having the above object, there is a lipstick container that is operated by rotating the container main body, without using a cap, which is as follows.

First, a lipstick container including a plate covering the upper portion of the container and a device opening the plate has been proposed (U.S. Pat. No. 6,056,465). However, the above relate art has a problem in that it is not good in appearance because the plate remains on the outer side of the container when the plate opens an opening.

Further, although other technologies for inserting plates in containers have been know in the related art, there are problems in that the external appearance is deteriorated by a portion of a plate protruding outside (U.S. Pat. Nos. 5,423,622, 2,386,417, 5,979,468, 2,486,073, 3,617,138, and 3,612,072), a plate is made of a flexible material, such that stability is reduced (U.S. Pat. Nos. 2,644,577, 5,890,826, and 5,904,431), it is difficult to produce and assemble in large quantities due to too many parts, or there is high probability that defective products will be made in assemblage (U.S. Pat. No. 5,171,096).

Further, a technology that uses a protrusion for operation, such as a handle, outside the container main body (U.S. Pat. Nos. 2,513,830 and 4,973,178). Since these technologies in the related art use new methods for users, not the existing methods, there is a problem in that these may repel consumers or give them inconvenience.

BRIEF SUMMARY

In order to overcome the above problems, it is an object of the present patent application to provide a one-hand lipstick container that can by easily operated and used by one hand.

It is another object of the present the present patent application to provide a one-hand lipstick container that can be designed to have an elegant external appearance by assembling all the part in a container cover and a container wain body such that the parts are not exposed to the outside.

It is another object of the present patent application to provide a one-hand lipstick container that can be used by rotating the container main body, similar to existing lipstick containers.

It is another object of the present patent application to provide a one-hand lipstick container in which the height of the container main body is optimized such that a user can take all action with the lipstick container in one hand.

A one-hand lipstick container for accomplishing the objects of the present patent application includes: a container main body having a cylinder stood at the center of a body and a center through-hole connected to the bottom of the body through the center of the cylinder; a container cover that is rotatably connected to the upper portion of the container main body and has an open inlet formed through the upper surface; a cover holder that is combined by a spiral with the outer side of the cylinder of the container main body in the container cover and vertically ascends/descends by rotational force of the container cover; a door that is hinged to the cover holder to open/close the upper portion of the cover holder, opens a passage when the cover holder descends, and closes the passage when the cover holder ascends; a lipstick housing that is combined by a spiral with the inner side of the center through-hole of the container main body in the cover holder vertically ascends/descends by rotational force of the cover holder, and ascends/descends in the opposite directions to the ascent/descent directions of the cover holder; and an anti-rotation means that transmits the rotational force of the cover holder to the lipstick housing and vertically guides the lipstick housing to ascend/descend in the opposite directions to the ascent/descent directions of the cover holder.

In this configuration, the center through-hole of the container main body is formed of an integral through-hole having the same inner diameter at the cylinder and at the body and an inner circumferential-spiral guide groove is formed on the inner side of the center through-hole.

Further, the lipstick housing ascending/descending with a lipstick is disposed in the center through-hole, and the lipstick housing has a cylindrical housing body and guide protrusions that are fitted in the inner circumferential-spiral guide groove are formed on the sides of the housing body.

Further, the anti-rotation means that prevents the lipstick housing from rotating with the center through-hole and allows the lipstick housing to rotate with the container cover is disposed between the lipstick housing and the center through-hole, and the anti-rotation means is formed of a pipe body and has a fixed end that is formed at the upper end of the pipe body and fitted in the cover holder to receive rotational force, and slide grooves that are vertically formed on the sides of the pipe body such that the guide protrusions formed on the lipstick housing are vertically guided through the slide grooves.

Further, the center-through hole of the container main body is formed of a two-coupled through-hole at the upper and lower portions, which has a large inner diameter at the cylinder and a small inner diameter at the body, the inner circumferential-spiral guide groove is formed on the inner side of the lower portion of the center through-hole of the body.

Further, the lipstick housing ascending/descending with a lipstick is disposed in the center through-hole, and the lipstick housing has the cylindrical housing body that is inserted in the upper portion of the center through-hole corresponding to the cylinder a slide column that extends from the bottom of the housing body and is fitted in the lower portion of the center through-hole corresponding to the body, and guide protrusions that are formed around the edge of the end of the slide column and are fitted in the inner circumferential-spiral guide groove.

Further, the anti-rotation means that prevents the lipstick housing from rotating with the center through-hole and allows the lipstick housing, to rotate with the container cover is disposed around the upper end of the lipstick housing.

Further, the anti-rotation means includes side protrusions protruding from the edge of the upper end of the pipe body of the lipstick housing and protrusion guide grooves, in which the slide protrusions are fitted and vertically guided, formed on the inner side of the cover holder.

Further, the anti-rotation means allows the lipstick housing to vertically move and prevent the lipstick housing from slipping in the rotational direction by having a surface contacting with the inner side of the cover holder on the upper surface of the lipstick housing, or a protrusion fitted in the cover holder.

Further, the outer circumferential-spiral guide groove spiraling opposite to the direction of the screw on the inner side of the container main body is formed on the outer side of the cylinder.

Further, the pitch of an outer circumferential-spiral guide groove formed on the outer side of the cylinder of the container main body is not uniform.

Further, the cover holder and the door are connected by soft or thin plastic.

Further, the cover holder and the door are formed by double injection molding.

Further, a protrusion having the same shape as the shape of the inlet of the container cover is formed on the upper surface of the door.

Further, the door is separated into one or more sections and the separate doors are connected to the sides of a cover holder to simultaneously open or cover the inlet of the container cover.

Further, an outer circumference rotational-combination protrusion is formed on the outer side of the cylinder of the container main body and a spiral guide groove in which the guide protrusions are spirally fitted is formed on the inner side of the cover holder.

Further, the height of the container main body and the container cover is about the same or the height of the container main body is slightly larger.

Further, the outer shape of the container main body and the container cover is formed by N straight or curved surfaces, N is a number from 3 to the infinity, and the shape corresponding to the infinity is a circle.

Further, a door guide groove that guides the upper end of the door when the door is opened is formed on the inner side of the container cover.

Further, the shape of the inlet at the upper portion of the container cover is different from the cross-sectional shape of the lipstick.

Further, the upper surface of the door is curved.

The present patent application having the configurations described above makes it possible to use the lipstick container with one hand, such that the use is simple and a good appearance is provided.

Further, according to the present patent application, since all the parts are assembled in the container cover and the container main body and the parts are not exposed to the outside, the external appearance of the lipstick container can be elegantly designed. In addition, since the lipstick container is used by rotating the container main body, similar to existing lipstick containers, users can familiarly use it, without strangeness.

Further, according to the present patent application, by optimizing the height of the container main body such that a user can take all action with the lipstick container in one hand, it is possible easily rotate the container cover with fingers while gripping the container main body with the palm, such that the use is convenient.

Further, the container main body and the container cover of the lipstick container can be made of high-strength synthetic resin, or metal or ceramic, and when the are made of metal, such as aluminum, it is possible to improve the quality of a product due to the peculiar luster and the feel of metal and decrease the thickness of a product, such that it is possible to decrease the entire size of the product, which contributes to refine the image of the product.

A one-hand lipstick container according to an embodiment of the present disclosure may comprise: a cylindrical main body extending in an axial direction; a cover holder rotatably received on an outer circumferential surface of the cylindrical main body via a first screw mechanism therebetween; a cover hinged to the cover holder to open and close an opening at an upper end of the one-hand lipstick container; a lipstick housing rotatably received on an inner circumferential surface of the cylindrical main body via a second screw mechanism therebetween, wherein the first screw mechanism and the second screw mechanism have opposite rotational directionalities to each other; an intermediate member interposed radially between the cylindrical main body and the lipstick housing, the intermediate member including a head and a guide sleeve extending from the head, wherein the head slidably engages with the cover holder to limit rotation of the cover holder relative to the intermediate member while allowing the cover holder to move in the axial direction relative to the intermediate member, wherein the guide sleeve slidably engages with the lipstick housing to limit rotation of the lipstick housing relative to the intermediate member while allowing the lipstick housing to move in the axial direction relative to the intermediate member; an upper case affixed to the intermediate member; a bottom case affixed to the cylindrical main body; and a cover guide attached to the head of the intermediate member, the cover guide including a cover guide groove along which the cover is guided.

In some embodiments, the first screw mechanism may include: a first helical guide groove provided on a threaded surface being one of the outer circumferential surface of the cylindrical main body and an inner circumferential surface of the cover holder; and a first protrusion provided on the other one of the outer circumferential surface of the cylindrical main body and the inner circumferential surface of the cover holder to slidably engage with the first helical guide groove; and an auxiliary guide groove disposed adjacent to an upper end of the first helical guide groove, wherein the auxiliary guide groove is separate from the first helical guide groove, and is configured to receive the first protrusion therein.

In some embodiments, an upper end of the auxiliary guide groove may taper to a pointed tip, so as to restrict further movement of the first protrusion away from the upper end of the auxiliary guide groove in response to a torque applied in a direction to open the one-hand lipstick container.

In some embodiments, a lower end of the auxiliary guide groove may have a gradually reduced depth to be level with the threaded surface, so as to allow the first protrusion to exit the auxiliary guide groove to reengage with the first helical guide groove in response to a torque applied in a direction to close the one-hand lipstick container.

In some embodiments, the auxiliary guide groove may extend diagonally to the axial direction, so as to generally follow the contour of the first helical guide groove.

In some embodiments, the one-hand lipstick container may further comprise: a cylinder member telescopically surrounding the lipstick housing, wherein the guide sleeve slidably engages with the cylinder member to limit rotation of the cylinder member relative to the intermediate member while allowing the cylinder member to move in the axial direction relative to the intermediate member, wherein the second screw mechanism includes: a second helical guide groove provided on the inner circumferential surface of the cylindrical main body; a second protrusion provided on an outer circumferential surface of the lipstick housing to slidably engage with the second helical guide groove; and a third protrusion provided on an outer circumferential surface of the cylinder member to slidably engage with the second helical guide groove, wherein the guide sleeve includes a first guide slot extending in the axial direction, through which each of the second protrusion and the third protrusion protrudes outward to slidably engage with the second helical guide groove, and wherein the cylinder member includes a second guide slot extending upward from a bottom end of the cylinder member in the axial direction, through which the second protrusion protrudes outward to slidably engage with the second helical guide groove, and wherein an upper end of the second guide slot is located at the same level as the third protrusion in the axial direction.

In some embodiments, wherein the second guide slot may include: a positioning portion located adjacent to the bottom end of the cylinder member and aligned with the third protrusion the axial direction; and a guide portion extending from the positioning portion and terminating in the upper end of the second guide slot, the guide portion being offset from the third protrusion the axial direction.

In some embodiments, the guide sleeve further may include: a first horizontal slot continuous with an upper end of the first guide slot and offset from the first guide slot in the axial direction; and a second horizontal slot continuous with a lower end of the first guide slot and offset from the first guide slot in the axial direction, wherein the second horizontal slot extends horizontally in a direction opposite to the first horizontal slot.

In some embodiments, the third protrusion may be located higher than the second protrusion is in the axial direction, where the one-hand lipstick container is in a fully closed state, the third protrusion may be located at the same level as the second protrusion is in the axial direction, where the one-hand lipstick container is in a fully open state, and a distance between the second protrusion and the third protrusion in the axial direction may diminish as the one-hand lipstick container is operated from the fully closed state to the fully open state.

In some embodiments, the head of the intermediate member may have an outer circumferential surface thereof configured to interlock with an inner circumferential surface of the upper case.

In some embodiments, the cover holder may include: an annular base; a first sliding part extending from the annular base; and a second sliding part extending from the annular base, disposed radially opposite the first sliding part, wherein the head of the intermediate member includes: a first vertical guide portion configured to receive the first sliding part of the cover holder slidably therealong in the axial direction; and a second vertical guide portion, disposed opposite the first vertical guide portion, configured to receive the second vertical guide portion of the cover holder slidably therealong in the axial direction.

A method of producing a one-hand lipstick container according to the present disclosure may comprise the steps of: providing a cylindrical main body extending in an axial direction; providing a cover holder rotatably received on an outer circumferential surface of the cylindrical main body via a first screw mechanism therebetween; providing a cover hinged to the cover holder to open and close an opening at an upper end of the one-hand lipstick container; providing a lipstick housing rotatably received on an inner circumferential surface of the cylindrical main body via a second screw mechanism therebetween, wherein the first screw mechanism and the second screw mechanism have opposite rotational directionalities to each other; providing an intermediate member interposed radially between the cylindrical main body and the lipstick housing, the intermediate member including a head and a guide sleeve extending from the head, wherein the head slidably engages with the cover holder to limit rotation of the cover holder relative to the intermediate member while allowing the cover holder to move in the axial direction relative to the intermediate member, wherein the guide sleeve engages with the lipstick housing to limit rotation of the lipstick housing relative to the intermediate member while allowing the lipstick housing to move in the axial direction relative to the intermediate member; providing an upper case affixed to the intermediate member; providing a bottom case affixed to the cylindrical main body; and providing a cover guide attached to the head of the intermediate member, the cover guide including a cover guide groove along which the cover is guided.

In some embodiments, the step of providing the cover guide may be performed independently of the step of providing the upper case and the step of providing the intermediate member.

In some embodiments, the step of providing the cover guide may be performed after the step of providing the cover.

An internal assembly for a one-hand lipstick container according to the present disclosure may comprise: a cylindrical main body extending in an axial direction; a cover holder rotatably received on an outer circumferential surface of the cylindrical main body via a first screw mechanism therebetween; a cover hinged to the cover holder to open and close an opening at an upper end of the one-hand lipstick container; a lipstick housing rotatably received on an inner circumferential surface of the cylindrical main body via a second screw mechanism therebetween, wherein the first screw mechanism and the second screw mechanism have opposite rotational directionalities to each other; an intermediate member interposed radially between the cylindrical main body and the lipstick housing, the intermediate member including a head and a guide sleeve extending from the head, wherein the head slidably engages with the cover holder to limit rotation of the cover holder relative to the intermediate member while allowing the cover holder to move in the axial direction relative to the intermediate member, wherein the guide sleeve slidably engages with the lipstick housing to limit rotation of the lipstick housing relative to the intermediate member while allowing the lipstick housing to move in the axial direction relative to the intermediate member; and a cover guide attached to the head of the intermediate member, the cover guide including a cover guide groove along which the cover is guided.

DETAILED DESCRIPTION

Figure 1:
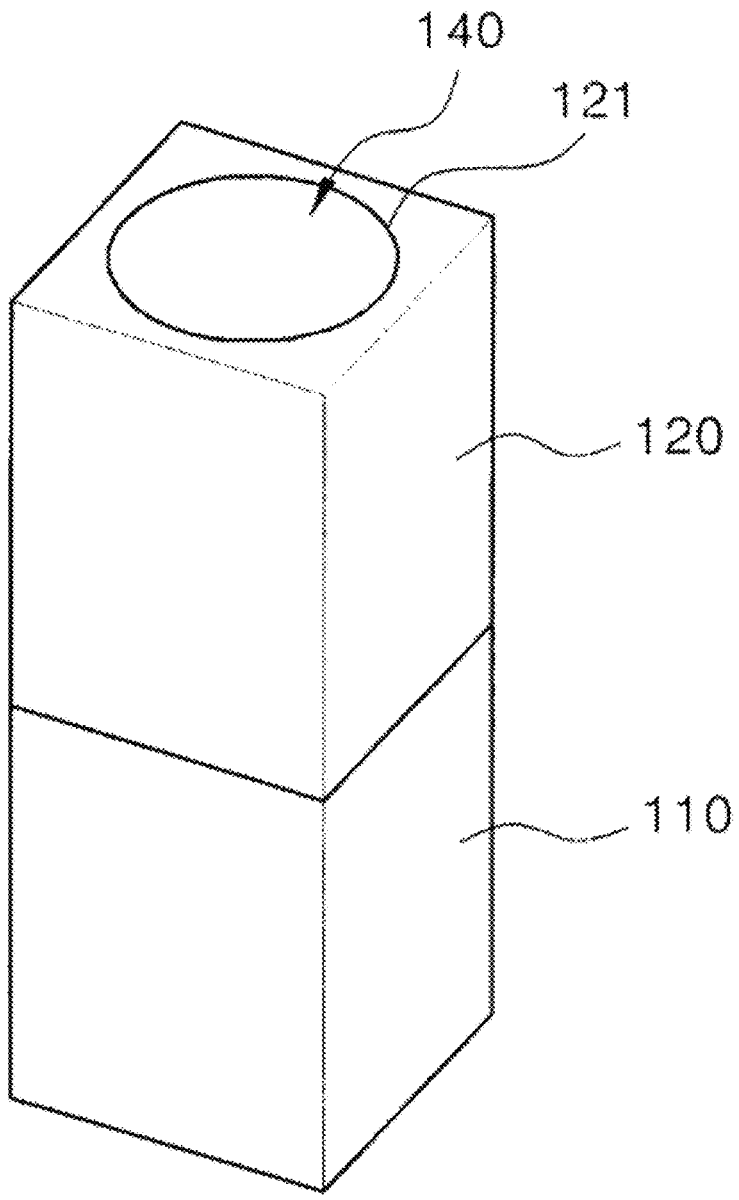
FIG. 1 is a perspective view of a one-hand lipstick container according to an embodiment of the present patent application.

Next, the embodiments of the present disclosure will be described clearly and concretely in conjunction with the accompanying drawings, which are described briefly above. The subject matter of the present disclosure is described with specificity to meet statutory requirements. However, the description itself is not intended to limit the scope of this disclosure. Rather, the inventors contemplate that the claimed subject matter might also be embodied in other ways, to include different steps or elements similar to the ones described in this document, in conjunction with other present or future technologies.

While the present technology has been described in connection with the embodiments of the various figures, it is to be understood that other similar embodiments may be used or modifications and additions may be made to the described embodiments for performing the same function of the present technology without deviating therefrom. Therefore, the present technology should not be limited to any single embodiment, but rather should be construed in breadth and scope in accordance with the appended claims. In addition, all other embodiments obtained by one of ordinary skill in the art based on embodiments described in this document are considered to be within the scope of this disclosure.

In describing preferred embodiments of the present disclosure illustrated in the drawings, specific terminology is employed for the sake of clarity. However, the present disclosure is not intended to be limited to the specific terminology so selected, and it is to be understood that each specific element includes all technical equivalents that operate in a similar manner to accomplish a similar purpose.

Hereinafter, a preferred embodiment of the present patent application is described in detail with reference to the accompanying drawings.

Figure 2:
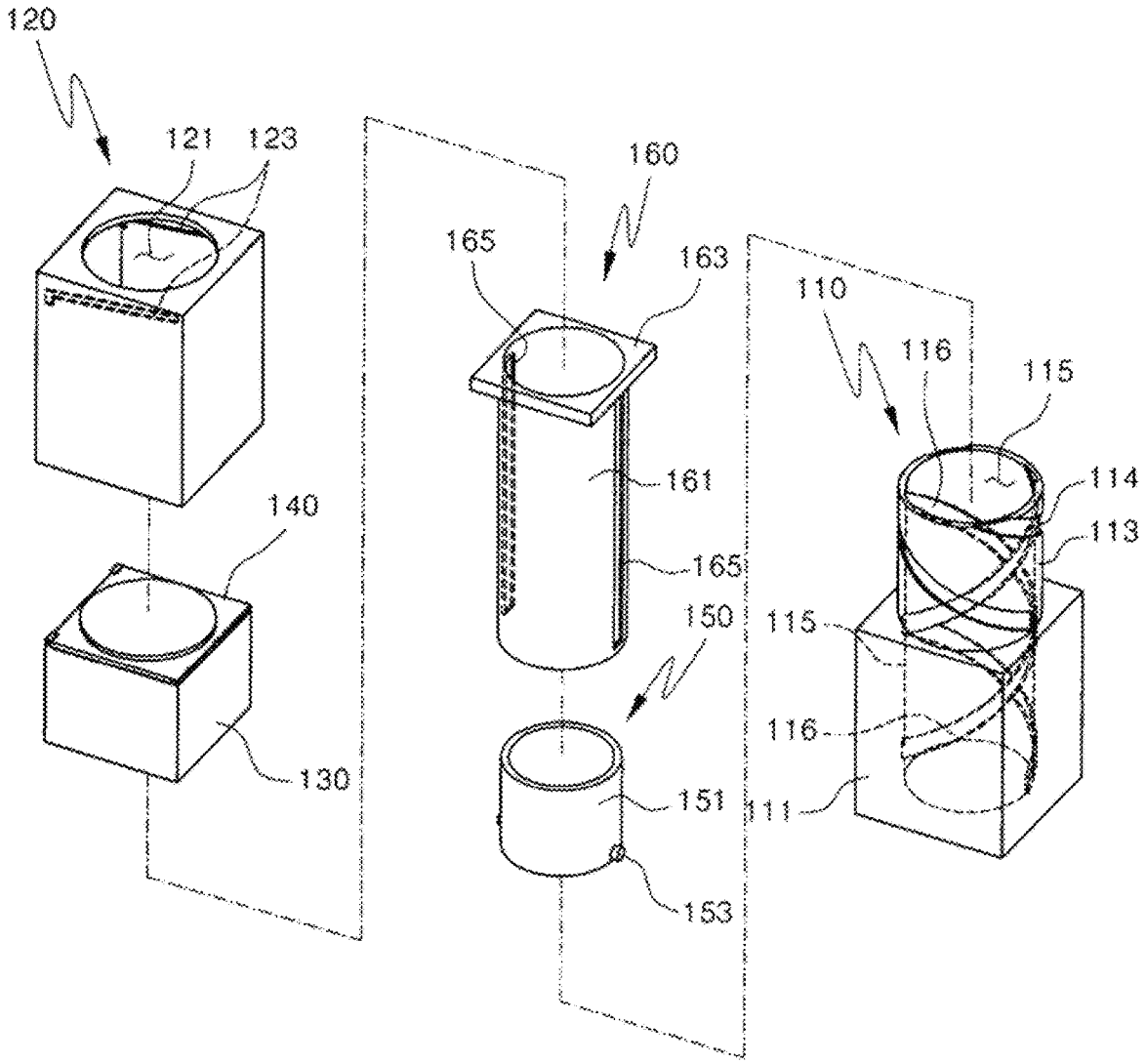
FIG. 2 is an exploded perspective view of the one-hand lipstick container according to an embodiment of the present patent application.
Figure 3:
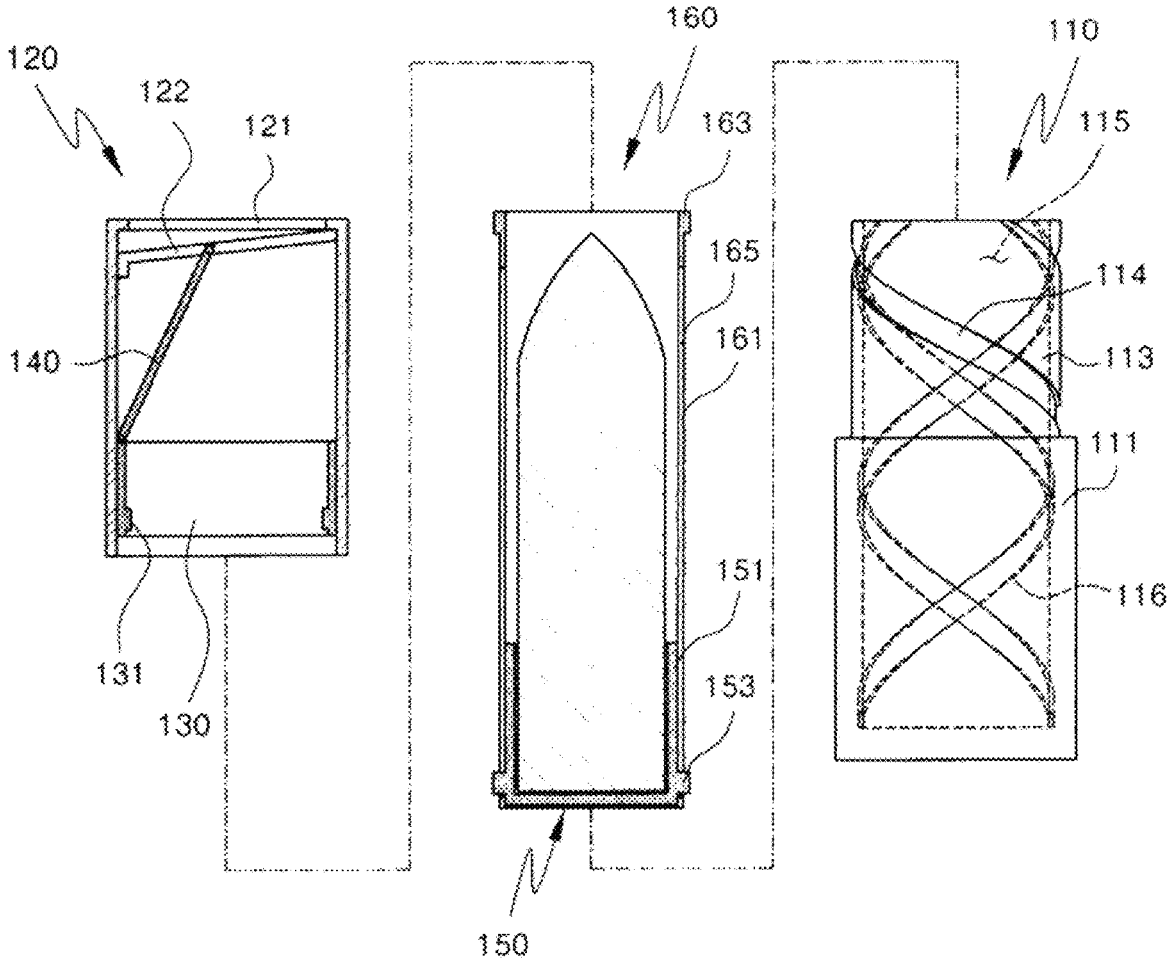
FIG. 3 is an exploded cross-sectional view of the one-hand lipstick container according to an embodiment of the present patent application.
Figure 4:
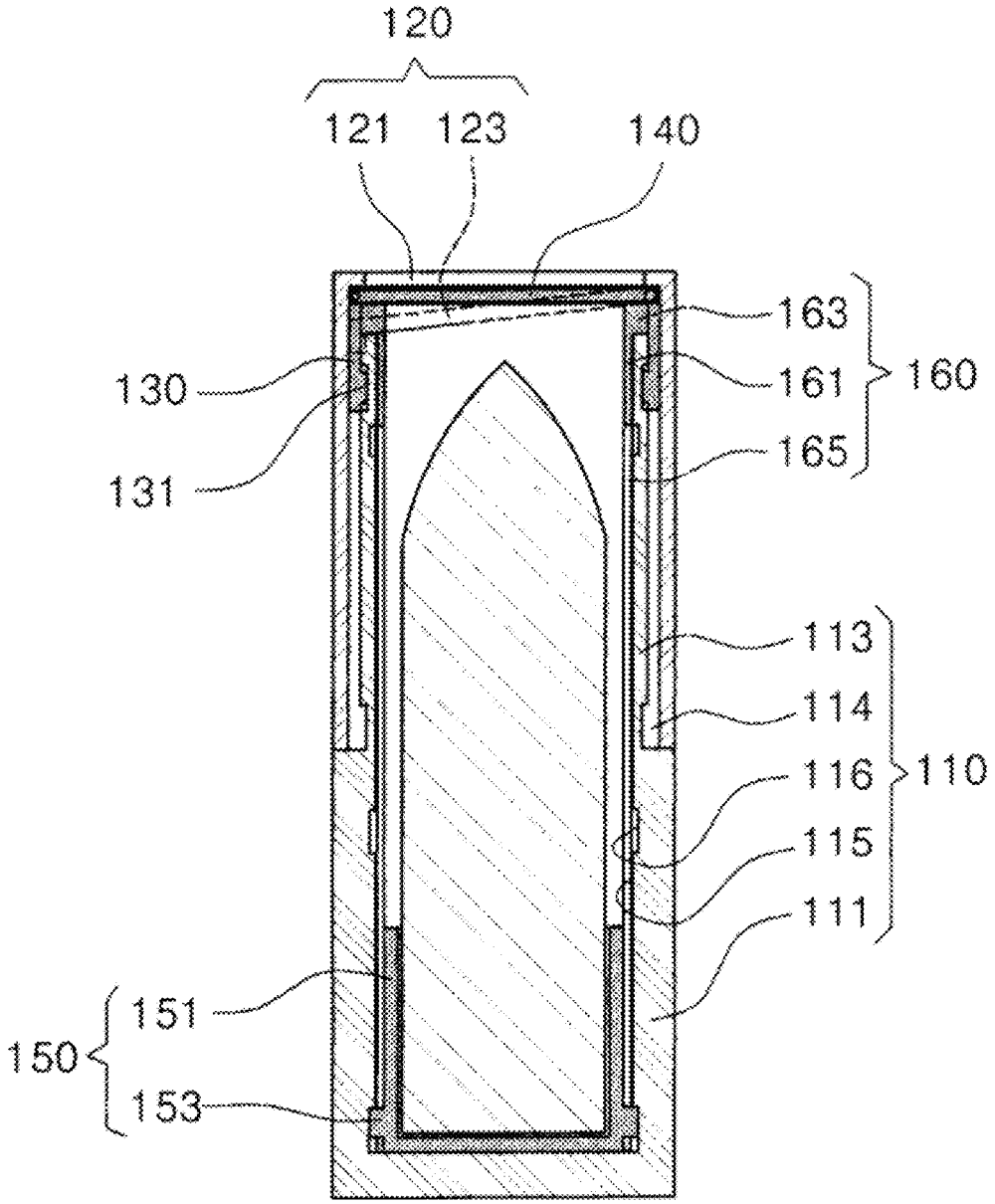
FIG. 4 is an assembly cross-sectional view of the one-hand lipstick container before it is used.
Figure 5:
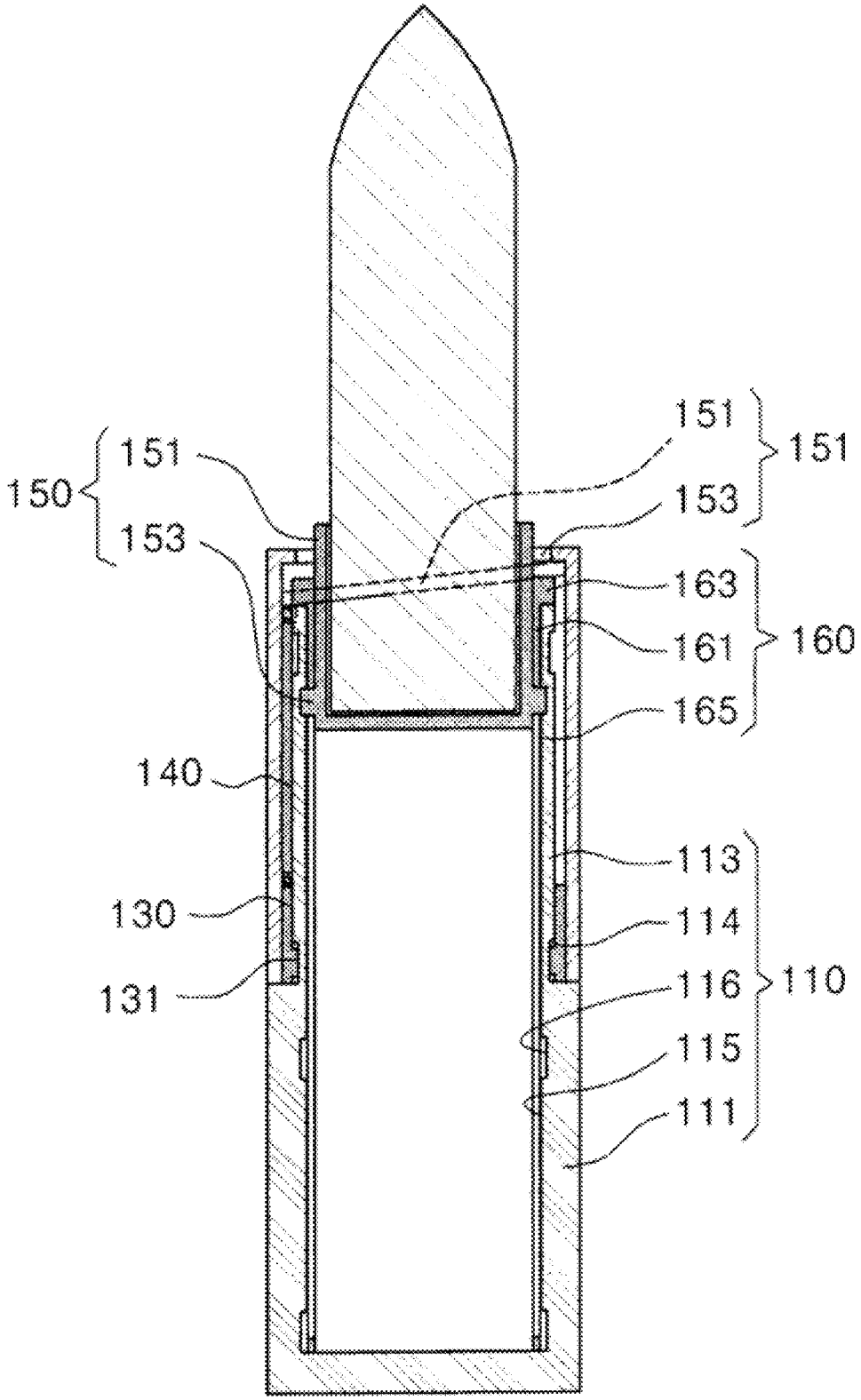
FIG. 5 is an assembly cross-sectional view of the one-hand lipstick container when it is being used, according to an embodiment of the present patent application.

FIG. 1 is a perspective view of a one-hand lipstick container according to an embodiment of the present patent application, FIG. 2 is an exploded perspective view of the one-hand lipstick container according to an embodiment of the present patent application, FIG. 3 is an exploded cross-sectional view of the one-hand lipstick container according to an embodiment of the present patent application, FIG. 4 is an assembly cross-sectional view of the one-hand lipstick container before it is used, according to an embodiment of the present patent application, and FIG. 5 is an assembly cross-sectional view of the one-hand lipstick container when it is being used, according to an embodiment of the present patent application.

As shown in FIGS. 1 to 5, a one-hand lipstick container according, to an embodiment of the present patent application includes a container main body 110, a container cover 120, a cover holder 130, a door 140, a lipstick housing 150, an anti-rotation mean 160.

Hereafter, each part of the one-hand lipstick container of the present patent application is described in detail.

First, the container main body 110 is described with reference to FIGS. 1 to 5. In the container main body 110, a cylinder 113 is stood at the center of a body 111 and a center through-hole 115 is formed through the center of the cylinder 113.

The body 111 has a rectangular shape, but the shape is not limited thereto and can be variously changed into a circular shape or a polygonal shape.

Further, the cylinder 113, as shown in FIGS. 2 and 3, has an outer circumferential-spiral guide groove 114, in which the outer circumferential-spiral guide groove 114 guides the cover holder 130, which is combined by a spiral, to rotate upward/downward.

Further, the center through-hole 115 is connected to the bottom of the body 111 and has an inner circumferential-spiral guide groove 116, in which the inner circumferential-spiral guide, groove 116 guides the lipstick housing 150 (described below) which is combined by a spiral, to rotate upward/downward.

In this configuration, the center through-hole 115 of the container main body 110 is an integral through-hole having the salve inner diameter from the upper end of the cylinder 113 to the bottom of the body 111.

Next, the container cover 120 is described with reference to FIGS. 1 to 5.

The container cover 120 is rotatably connected to the upper portion of the container main body 110 and has an open inlet 121 formed through the upper surface.

The inlet 121 allows a lipstick received in the lipstick housing 150, which is combined with the container main body 110 and ascends/descends, to protrude outside, and as shown in FIGS. 2 and 3, the inlet 121 is opened or closed by the cover holder 130 and the door 140 that are disposed in the container cover 120 and ascends/descends.

A door guide groove 123 that guides the upper end opening/closing-path of the door 140 in accordance with the ascent/descent of the cover holder 130 is formed on the inner side of the container cover 120.

The container cover 120 has a rectangular shape, but the shape is not limited thereto and can be variously changed into a circular shape or a polygonal shape.

Next, the cover holder 130 is described with reference to FIGS. 2 to 5. The cover holder 130 is disposed in the container cover 120 and ascends/descends, in which the cover holder 130 and the container cover 120 are combined only to vertically slide, without rotating with respect to each other.

For this configuration, a rail may be formed to guide the sliding movement with respect to each other, but, as shown in FIGS. 2 and 3, it is possible to form the same inner shape (rectangular shape in the figures) while preventing rotation with respect to each other and allowing for free vertical movement.

Meanwhile, the cover holder 130 is combined by a spiral while covering the outer side of the cylinder 113 of the container main body 110, and for this, an outer circumference rotational-combination protrusion 131 that is fitted in the outer circumference spiral guide groove 114 formed on the cylinder 113 protrudes inward from the inner side of the cover holder 130.

As the container cover 120 rotates, the cover holder 130 is correspondingly rotated by the rotational force of the container cover 120, and also vertically ascends/descends along the outer circumference spiral guide groove 114, using the rotational force.

Next, the door 140 is described with reference to FIGS. 3 to 5.

The door 140 is combined with the cover holder 130 to open/close the upper portion and of which one end is hinged to a side of the cover holder 130 and the opposite end is fitted in the door guide groove 123 formed on the inner side of the container cover 120.

As the cover holder 130 descends, the end of the door 140 hinged to the cover holder 130 descends, and at the same time, the opposite end moves along the opening-path of the door guide groove 123, such that the inlet 121 of the container cover 120 is opened.

Then the inlet 121 is fully opened, the door 140 is vertically stood and stops descending, which is the same as the last descent timing of the cover holder 130.

On the contrary, as the cover holder 130 ascends, the door 140 moves along the closing-path of the door guide groove 123, such that the inlet 121 of the container cover 120 is closed.

The ascent/descent of the cover holder 130 is performed by the rotational force of the container cover 120.

Figure 6:
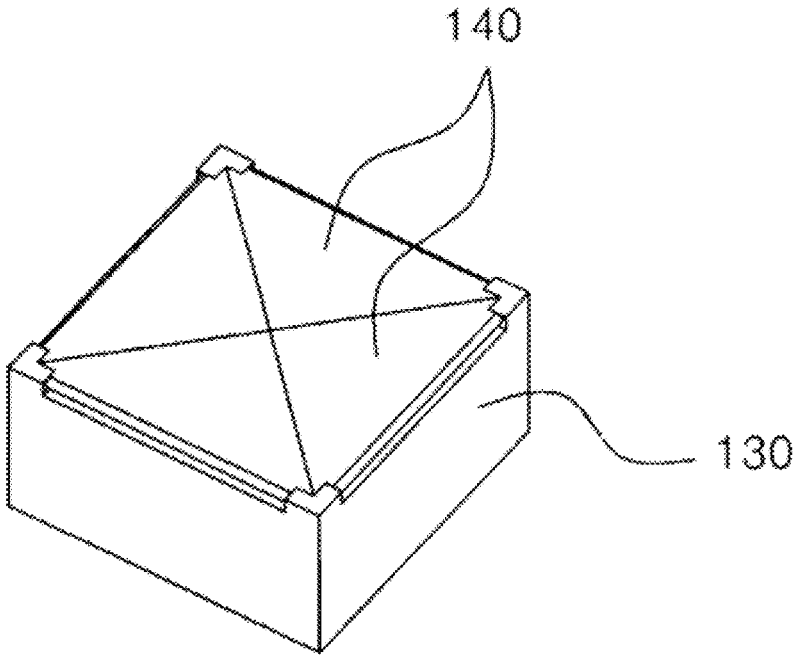
FIGS. 6 to 8 are perspective view showing a modified embodiment of the cover holder and the door of the present patent application.
Figure 7:
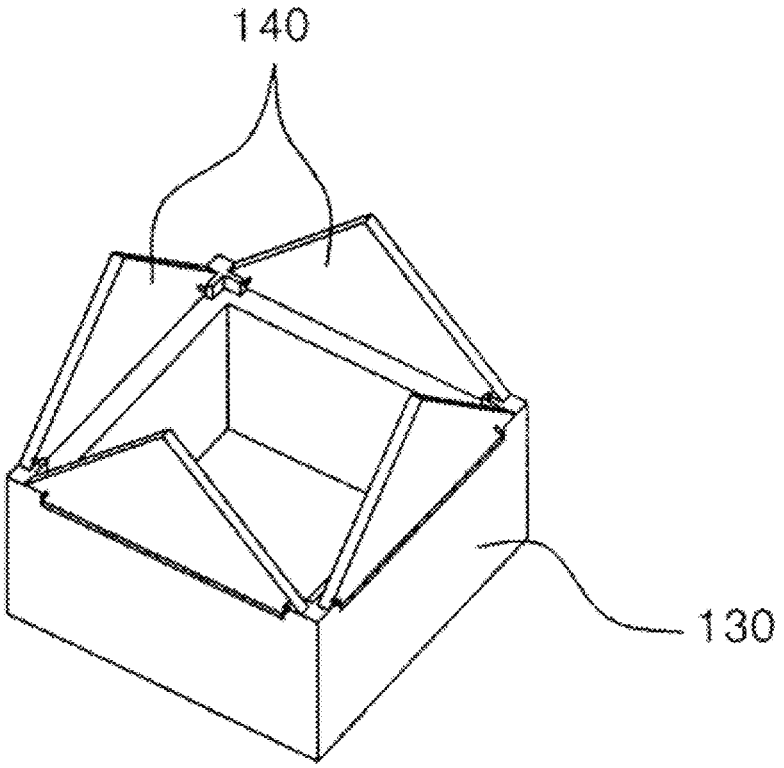
Figure 8:
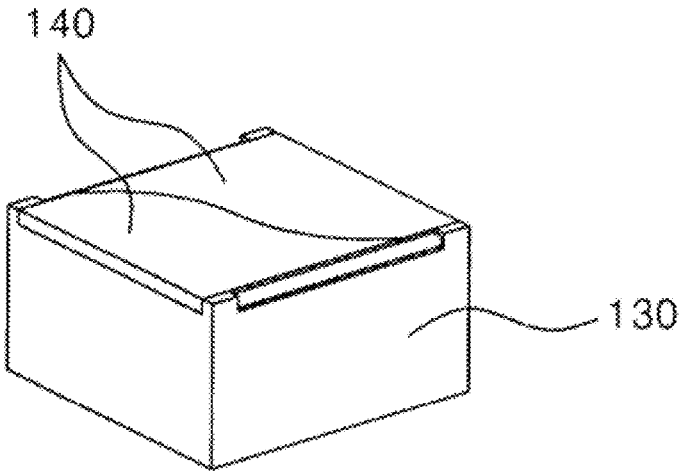

FIGS. 6 to 8 are perspective view showing a modified embodiment of the cover holder and the door of the present patent application.

A door 140 of the present patent application shown in the figures is separated into one or more sections and the separate doors 140 are connected to the sides of a cover holder 130, such that it is possible to simultaneously open or cover the inlet 121 of the container cover 120.

That is, as shown in FIGS. 6 and 7, it is possible to form the door 140 in a type of hinged door while simultaneously forming four doors separated diagonally.

Further, as shown in FIG. 8, it is also possible to form the door 140 in a type of hinged door with two separate half doors. In these configurations, the door 140 separated in a plurality of doors can be formed in various shapes by straight or curved boundary lines, or combinations of them (a Taegeuk pattern is shown in FIG. 8).

By separating the door 140 into a plurality of doors and operating it, as described above, the height of the door 140 is decreased, and accordingly, it is possible to reduce the movement distance for opening/closing of the door 140, such that it is possible to design a compact product.

Figure 9:
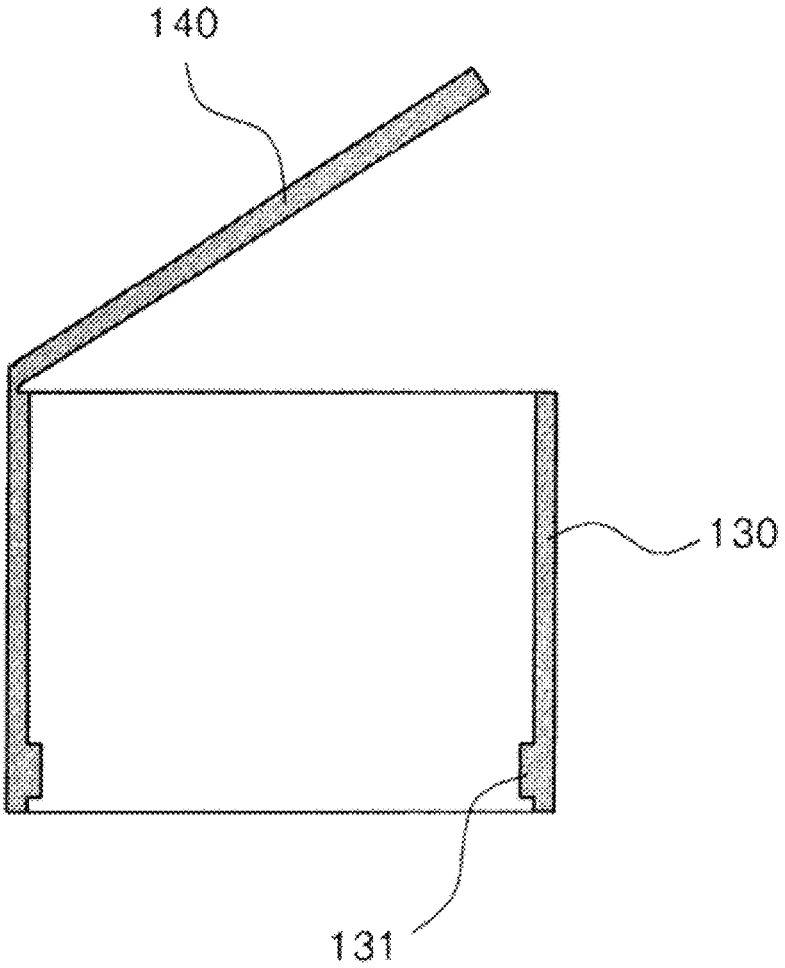
FIG. 9 is a cross-sectional view showing an example of a cover holder and a door integrally formed by injection molding according to the present patent application.

FIG. 9 is a cross-sectional view showing an example of a cover holder and a door integrally formed by injection molding according to the present patent application, and as shown in the figure, a cover holder 130 and a door 140 of the present patent application can be integrally manufactured by injection-molding the connecting portion using soft or thin plastic, without using a hinge pin.

Further, it is possible to form the cover holder 130 and the door 140 by double injection molding, which can provide a peculiar appearance by changing the material or the color of the door 140 protruding outside. The double injection molding allows for making the colors of the doors different, when simultaneously forming a plurality of doors 140.

Further, as shown in FIG. 2, a protrusion having the same shape of that of the inlet 121 of the container cover 120 may be formed on the upper surface of the door 140, in which the protrusion may be thrilled on the same surface as the inlet 121 of the container cover 120 or may protrude upward further than the inlet 121.

Alternatively, it is possible to forth a variety of patterns on the surface of the door 140 using raised or depressed patterns.

Figure 10:
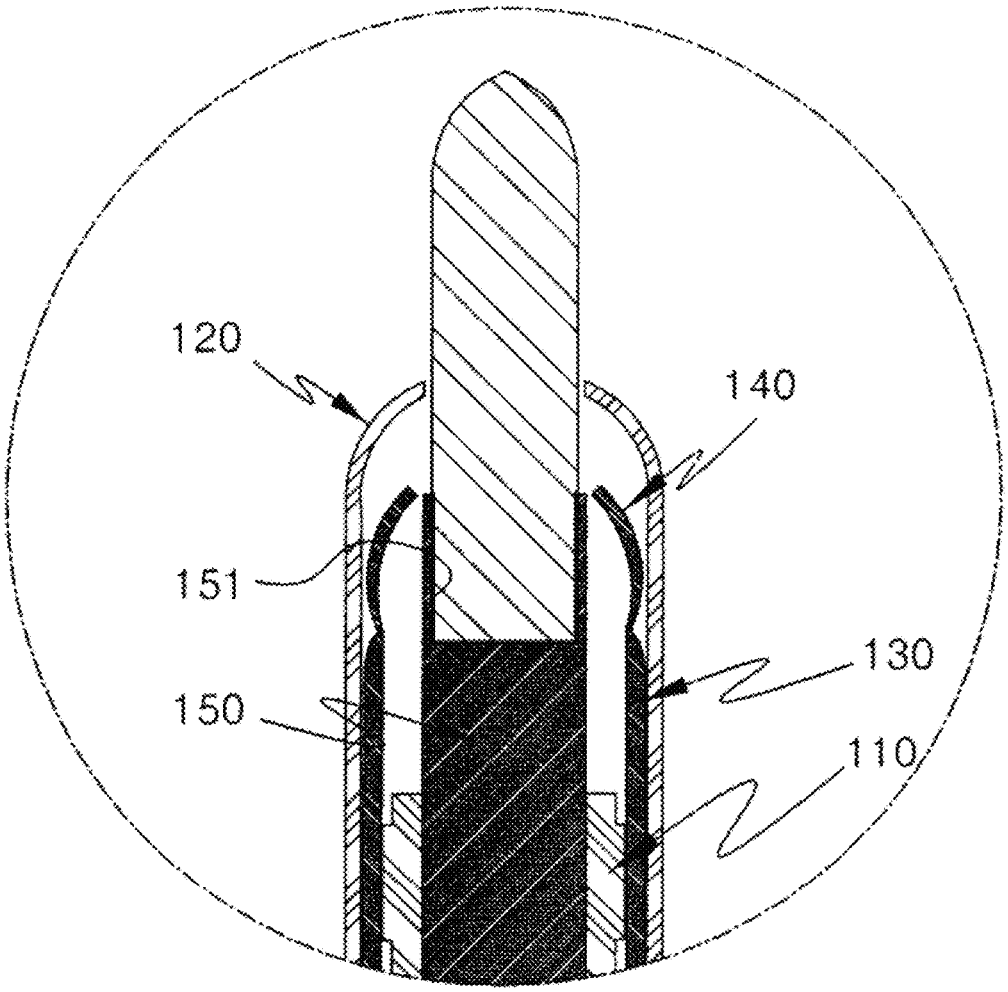
FIG. 10 is an assembly cross-sectional view showing an example of manufacturing the upper surfaces of the container cover and the door of the invention in dome shapes.

FIG. 10 is an assembly cross-sectional view showing an example of manufacturing the upper surfaces of the container cover and the door of the invention in dome shapes, and as shown in the figure, the upper surface of door 140 may be curved in a dome shape. In this configuration, it is possible to curve the upper surface of the container cover 120 to have a dome shape, which can emphasize a soft image of the product to users. In this example, the door 140 can be manufactured by both injection molding and hinge combination.

Next, the lipstick housing 150 is described in detail with reference to FIGS. 2 to 5.

The lipstick housing 150 is combined with the container main body 110 by the inner circumferential-spiral guide groove 116 formed on the center through-hole 115 of the container main body 110 to ascend/descend, and has a cylindrical housing body 151 where a lipstick is received and guide protrusions 153 that protrude on the outer side of the housing body 151 to be spirally fitted in the inner circumferential-spiral guide groove 116.

The lipstick housing 150 rotates with the cover holder 130 by the anti-rotation means 160 and vertically ascends/descends in accordance with the rotational direction.

In this configuration, it is important to form the spirals of the inner circumferential-spiral guide groove 116 and the outer circumferential-spiral guide groove 114 in the opposite directions.

This is for conversely operating the ascent/descent of the cover holder 130 and the ascent/descent of the lipstick housing 150.

That is, in a one-hand lipstick container of the present patent application, as the cover holder 130 opens the door 140 while descending and the inlet 121 of the container cover 120 is opened, the lipstick housing 150 protrudes a lipstick outside through the inlet 121 of the container cover 120 while ascending.

Next, the anti-rotation means 160 is described in detail with reference to FIGS. 2 to 5.

The anti-rotation means 160 transmits the rotational force of the cover holder 130 to the lipstick housing 150 disposed in the center through-hole 115 and guides the lipstick housing 150 to ascend/descend in the opposite directions to the cover holder 130.

The anti-rotation means 160 is composed of a pipe body 161 that is disposed between the lipstick housing 150 and the center through-hole 115, a fixed end 163 that is connected to the cover holder 130 at the upper end of the pipe body 161, and slide grooves 165 that are vertically formed on the sides of the pipe body 161.

The fixed end 163 can be manufactured in a rectangular shape.

Meanwhile, the slide grooves 165 allows the guide protrusions 153 of the lipstick housing 150 to be spirally fitted in the inner circumference spiral guide groove 116 through it such that rotational force is transmitted to the lipstick housing 150 by the guide protrusions 153, when the anti-rotation means 160 is rotated by the rotational force of the cover holder 130.

The lipstick housing 150 is guided to ascend/descend along the inner circumferential-spiral guide groove 116 in the opposite direction to the cover holder 130 and vertically along the slide grooves 165 of the anti-rotation means 160.

Hereafter, the operation of a one-hand lipstick container according to an embodiment of the present patent application is described with reference to FIGS. 4 and 5.

In FIG. 4, the inlet 121 of the container cover 120 is closed by the door 140 and the lipstick housing 150 has descended to the bottom of the container main body 110.

First, as shown in FIG. 4, a user rotates the container cover 120 with fingers, with the container body 110 in one hand.

In this operation, the cover holder 130 is rotated with the container main body 110 and the cover holder 130 descends while rotating along the outer circumferential-spiral guide groove 114 formed on the cylinder 113.

As shown in FIG. 5, as the cover holder 130 vertically descends along the inner side of the container cover 120, one end of the door 140 hinged to the cover holder 130 descends, and at the same time, the opposite end moves along the opening-path of the door guide groove 123, such that the inlet 121 of the container cover 120 is opened.

When the inlet 121 is hilly opened, the door 140 is vertically stood and stops descending, which is the same as the last descent timing of the cover holder 130.

In this operation, the cover holder 130 descends, while the lipstick housing 150 ascends, in which since the lipstick housing 150 is rotated with the cover holder 130 by the anti-rotation means 160, they ascend/descend along the inner circumferential-spiral guide groove 116.

In this operation, the anti-rotation means 160 and the cover holder 130 cannot rotate with respect to each other, whereas they are combined to freely vertically slide.

That is, the cover holder 130 can transmit rotational force to the anti-rotation means 160 and descend.

The lipstick housing 150 that is received the rotational force from the anti-rotation means 160 ascends along, the inner circumferential-spiral guide groove 116 in the opposite direction to the cover holder 130 and vertically along the slide grooves 165 of the anti-rotation means 160 such that the lipstick protrudes through the inlet 121 of the container cover 120.

The present patent application described above is characterized in that the outer circumferential-spiral guide groove 114 spiraling opposite to the direction of the screw on the inner side of the container main body 110 is formed on the outer side of the cylinder 113.

This configuration is provided in order that when the lipstick housing 150 ascends along the inner circumferential-spiral guide groove 116, the cover holder 130 descends along the outer circumferential-spiral guide groove 114 of the cylinder 113, and at the same time, the door 140 is opened and the lipstick protrudes through the inlet 121 of the container cover 120.

Figure 11:
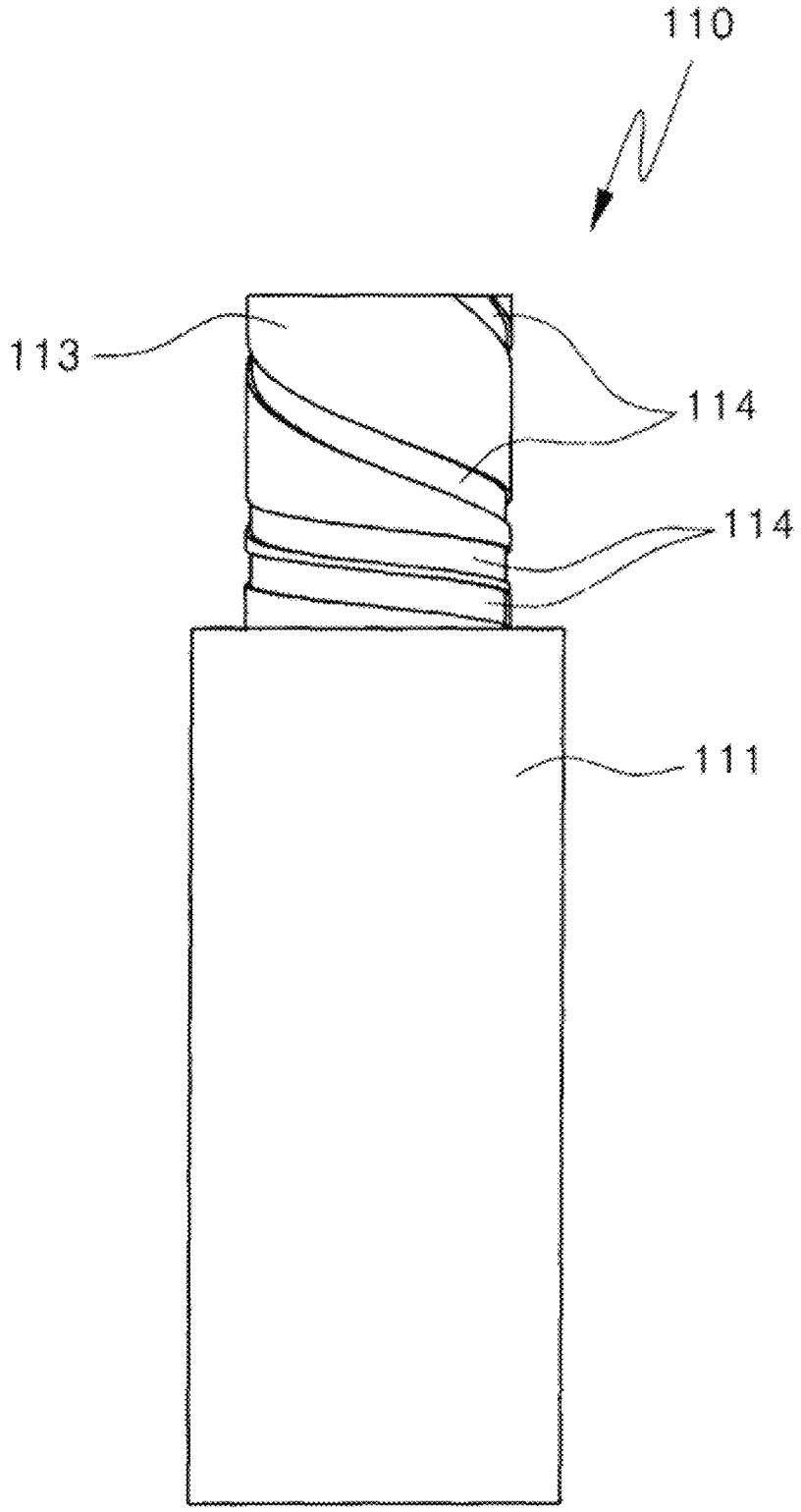
FIG. 11 is a front view showing an example of forming different pitches of an outer circumferential-spiral guide groove of the container main body of the present patent application.

For this operation, in the present patent application, it is possible to ununiformly form the pitch of the outer circumferential-spiral guide groove 114 on the outer side of the cylinder 113 of the container rain body 110, as shown in FIG. 11, and for example, it is possible to make wide the pitch of the upper section in the entire section and relatively narrow the pitch of the lower section.

FIG. 11 is a front view showing an example of forming different pitches of an outer circumferential-spiral guide groove of the container main body of the present patent application.

As shown in the figure, the reason that the pitch of the outer circumferential-spiral guide groove 114 is ununiform is because the descent section of the cover holder 130 is relatively shorter than the ascent section of the lipstick housing 150. Further, the uniform pitch is provided in order to first open the inlet 121 of the container cover 120 by rapidly moving down cover holder 130 in the upper section of the outer circumferential-spiral guide groove 114, and then maintain the rotation while the lipstick housing 150 ascends to the highest level by reducing the pitch gap such that the cover holder 130 descends slow in the lower section.

Further, according to the present patent application, in contrast to the above description, it is also possible to ununiformly form the pitch of the inner circumferential-spiral guide groove 116, in which the pitch is set small at the lower section such that the lipstick housing ascends slow while waiting for the opening tuning of the door 140, and the pitch is set large after the door 140 is opened such that it can rapidly ascend.

Further, though not shown in the figures of the present patent application, it is possible to taper the lower portion or the upper portion of the outer circumferential-spiral guide groove 114, instead of ununiformly forming the pitch of the outer circumferential-spiral guide groove 114.

As described above, when the lower portion or the ripper portion of the outer circumferential-spiral guide groove 114 is tapered, when the cover holder 130 is locked and cannot further rotate in rotating in any one direction of the left and right, the guide protrusions spirally fitted in the outer circumferential-spiral guide groove 114 are separated from the outer circumferential-spiral guide groove 114 in the tapered direction and slip on the outer surface of the cylinder 113.

That is, a kind of idling condition is provided such that the cover holder 130 idles until the lipstick housing 150 reaches the highest position.

In this configuration, when the cover holder 130 is reversely rotated, the guide protrusions are inserted in the outer circumferential-spiral guide groove 114, and then are guided to the opposite side, which is not tapered, and ascend or descend.

Further, it is also possible to make the cover holder 130 idle until the lipstick housing 150 reaches the maximum descent position, by separating the guide protrusions from the outer circumferential-spiral guide groove 114 in the rotational direction when the cover holder 130 reaches the maximum ascent position.

Hereafter, a one-hand lipstick container according to another embodiment of the present patent application is provided With reference to FIGS. 12 to 16.

Figure 12:
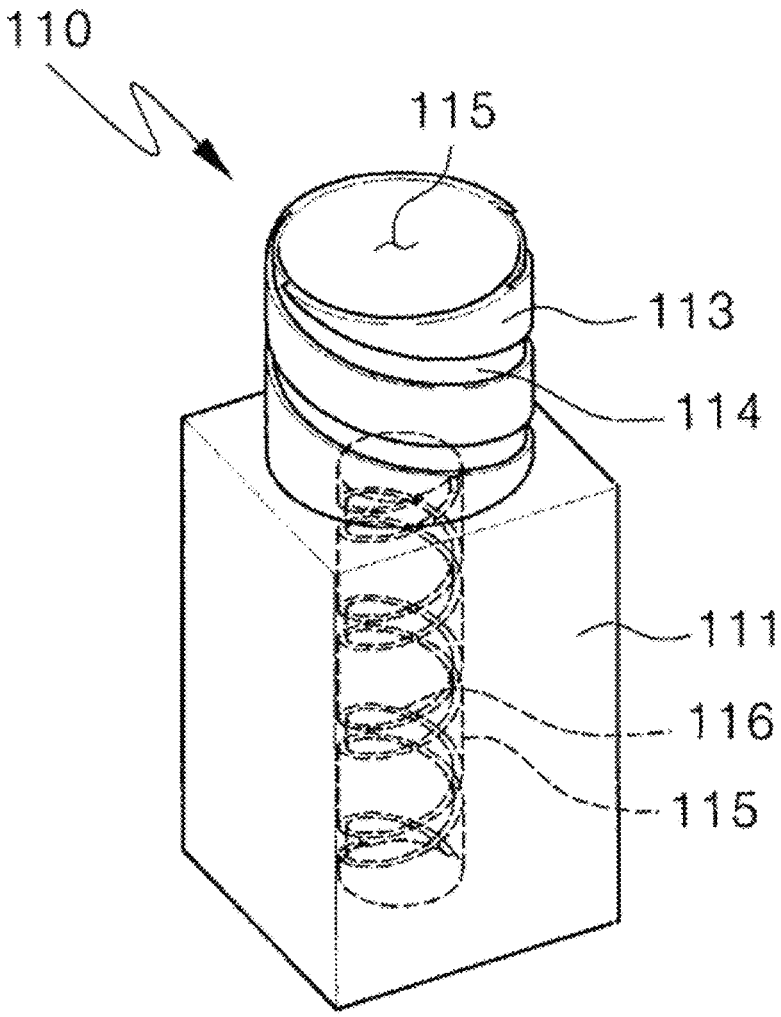
FIG. 12 is a perspective View showing the structure of a one-hand lipstick container according to another embodiment of the present patent application.

FIG. 12 is a perspective view showing the structure of a one-hand lipstick container according to another embodiment of the present patent application, and as shown in the figure, in the one-hand lipstick container according to another embodiment of the present patent application, a center through-hole 115 of a container main body 110 is formed of a two-coupled center through-hole 115 composed of a portion having a large inner diameter at a cylinder 113 and a portion having a small inner diameter at the body 111. Further, an inner circumferential-spiral guide groove 116 is formed on the inner side of the lower portion of the center through-hole 115 in the body 111.

Figure 13:
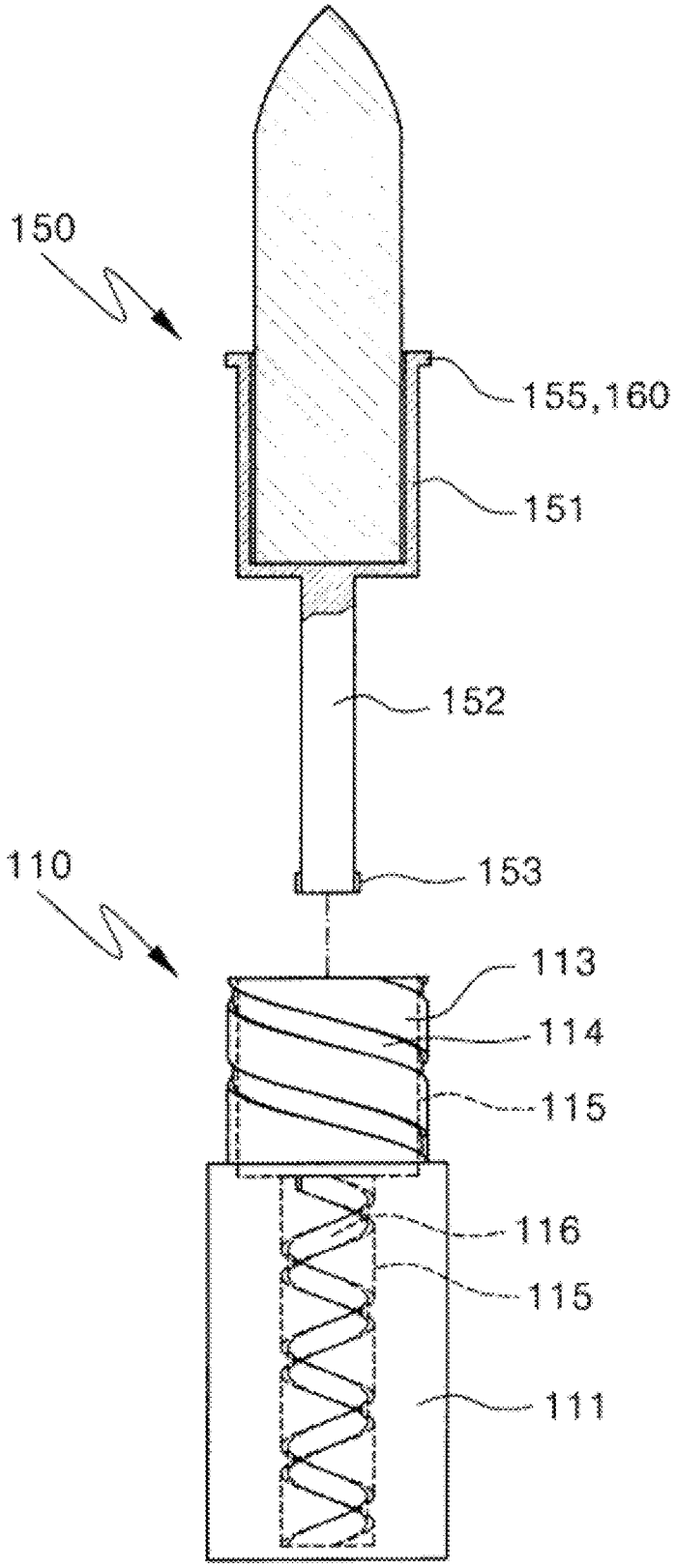
FIG. 13 is an exploded view showing when a container main body is combined with a lipstick housing according to another embodiment of the present patent application

FIG. 13 is an exploded view showing when the container main body is combined with a lipstick housing according to another embodiment of the present patent application, and as shown in this figure, the lipstick housing 150 ascends/descends with a lipstick therein is disposed in the center through-hole 150.

In this configuration, the lipstick housing 150 has a cylindrical housing body 151 that is inserted in the upper portion of the center through-hole 115 of the cylinder 113 and a slide column 152 that extends down from the housing body 151 and is inserted in the lower portion of the center through-hole 115 in the body 111, and a guide protrusion 153 that is fitted in an inner circumferential-spiral guide groove 116 protrudes around the end of the slide column 152.

The configuration of the container cover 120, the cover holder 130, and the door 140 of the lipstick container according to the embodiment of the present patent application shown in FIGS. 1 to 11 can be applied in the same way to the lipstick container according to another embodiment of the present patent application, shown in FIGS. 12 and 13.

Accordingly, the description for the configuration and operation of them is not provided, and the configuration and relationship of the container main body 110, the lipstick housing 150, the cover holder 130, and the anti-rotation means 160 are described in detail.

Another embodiment of the present patent application described above can be changed in various ways in accordance with the configuration of the anti-rotation means 160.

The anti-rotation means 160 transmits the rotational force of the cover holder 130 to the lipstick housing 150 disposed in the center through-hole 115 of the container main body 110 and guides the lipstick housing 150 to ascend/descend in the opposite directions to the cover holder 130.

First, as shown in FIG. 13, it is possible to form the anti-rotation means 160 around the upper end of the lipstick housing 150, and the anti-rotation means 160 can be formed by horizontally extending a protrusion or the edge around the upper end of the lipstick housing 150.

Figure 14:
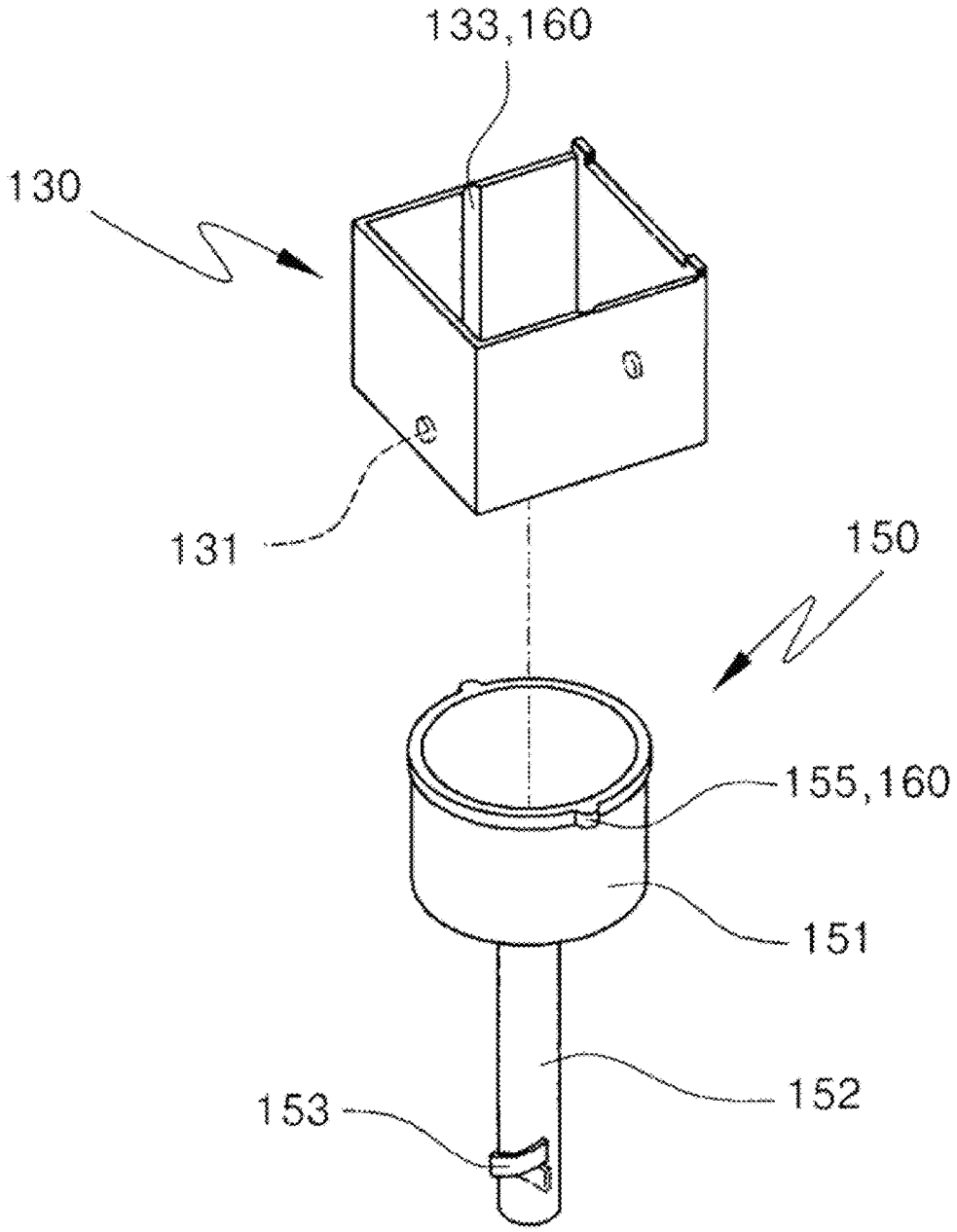
FIG. 14 is an exploded perspective view showing an example of forming a slide protrusion at the upper end of the lipstick housing and a protrusion guide groove, which is fitted on the slide protrusion, on the inner side of the cover holder to prevent rotation, according to another embodiment of the present patent application.

FIG. 14 is an exploded perspective view showing an example of forming a slide protrusion at the upper end of the lipstick housing and a protrusion guide groove, which is fitted on the slide protrusion, on the inner side of the cover holder to prevent rotation, according to another embodiment of the present patent application.

As shown in the figure, the anti-rotation means 160 can be implemented by forming side protrusions 155 protruding from the edge of the upper end of a pipe body 161 of the lipstick housing 150 and protrusion guide grooves 133, in which the slide protrusions 155 are fitted, on the inner side of the cover holder 130, and then fitting the slide protrusions 155 in the protrusion guide grooves 133.

Figure 15:
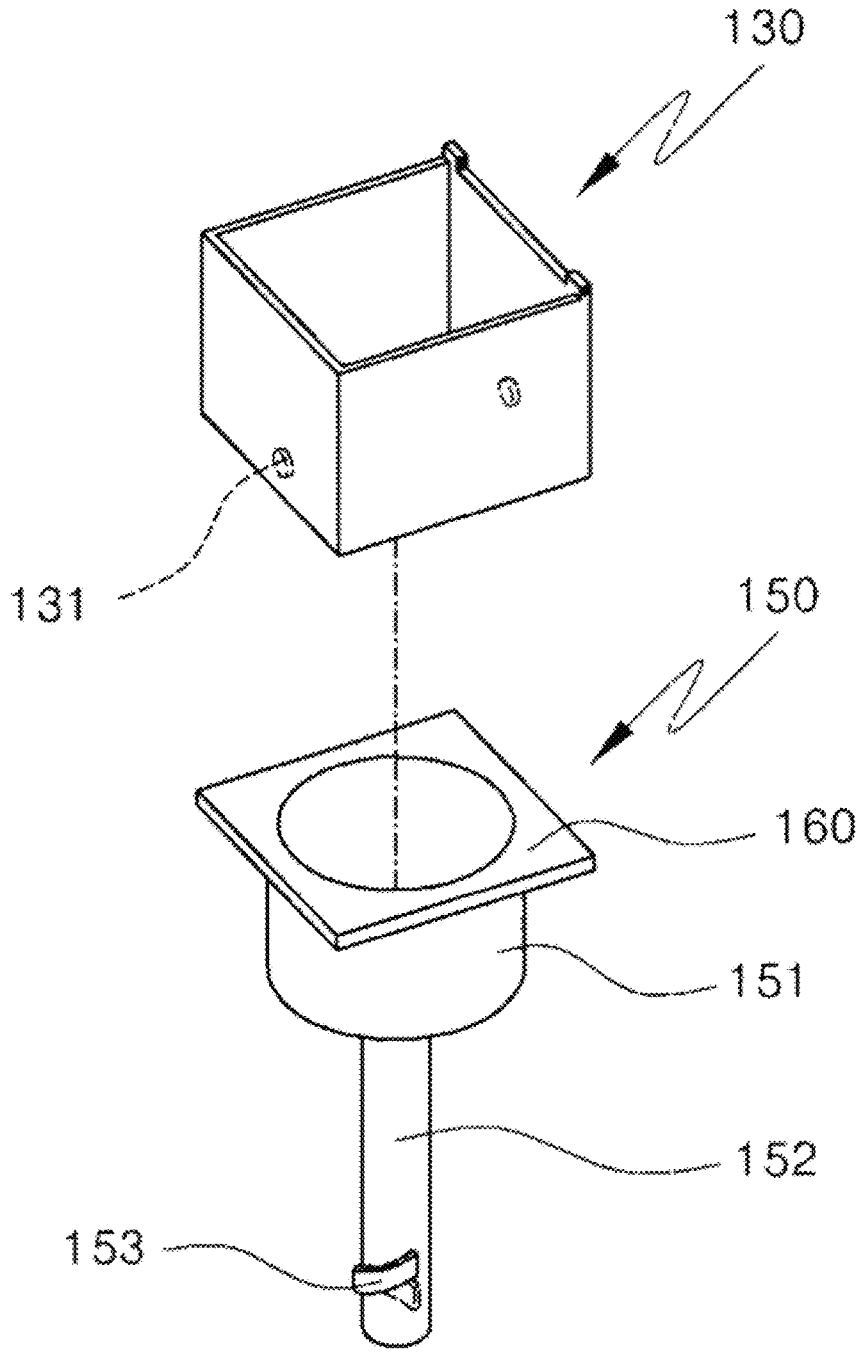
FIG. 15 is an exploded perspective view showing an example of forming a rectangular edge at the upper end of the lipstick housing to prevent rotation when being combined with the cover holder.

FIG. 15 is an exploded perspective view showing an example of forming a rectangular edge at the upper end of the lipstick housing to prevent rotation when being combined with the cover holder.

As shown in the figure, the anti-rotation means 160 can have a configuration in which a rectangular plate-shaped edge part is formed around the upper end of the pipe body 161 of the lipstick housing 150 and the edge part is fitted inside the cover holder 130 to prevent rotation.

Figure 16:
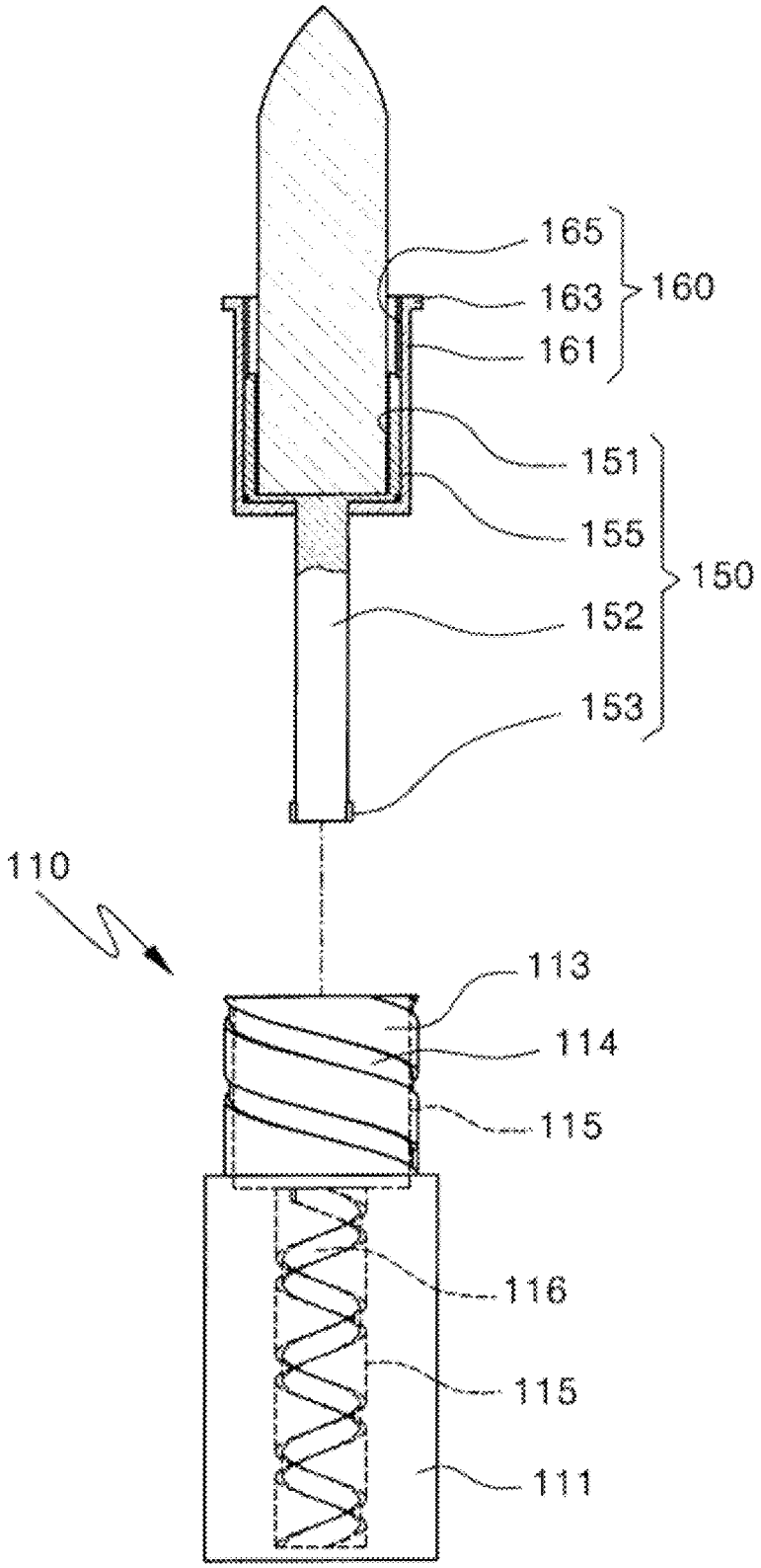
FIG. 16 is a cross-sectional view showing an example when the lipstick housing is inserted in the anti-rotation means according to the present patent application.

FIG. 16 is a cross-sectional view showing an example when the lipstick housing is inserted in the anti-rotation means according to the present patent application.

As shown in the figure, the anti-rotation means 160 is formed of a pipe body 161 that is inserted in the center through-hole 115, a fixed end 163 that is fitted inside the cover holder 130 and receives rotational force is formed at the upper end of the pipe body 161, and slide grooves 165 are vertically formed on the inner side of the pipe body 161.

In this configuration, the lipstick housing 150 is received in the pipe body 161 and rail-shaped slide protrusions 155 that are fitted in the slide grooves 165 are formed on the sides of the housing body 151 of the lipstick housing 150.

The slide column 152 of the lipstick housing 150 passes through the bottom of the pipe body 161, and as shown in FIG. 13, the slide column 152 is spirally fitted in the inner circumferential-spiral guide groove 116 at the lower portion.

In this configuration, a guide protrusion 153 for spiral fitting is formed at the lower end of the slide column 152.

Figure 17:
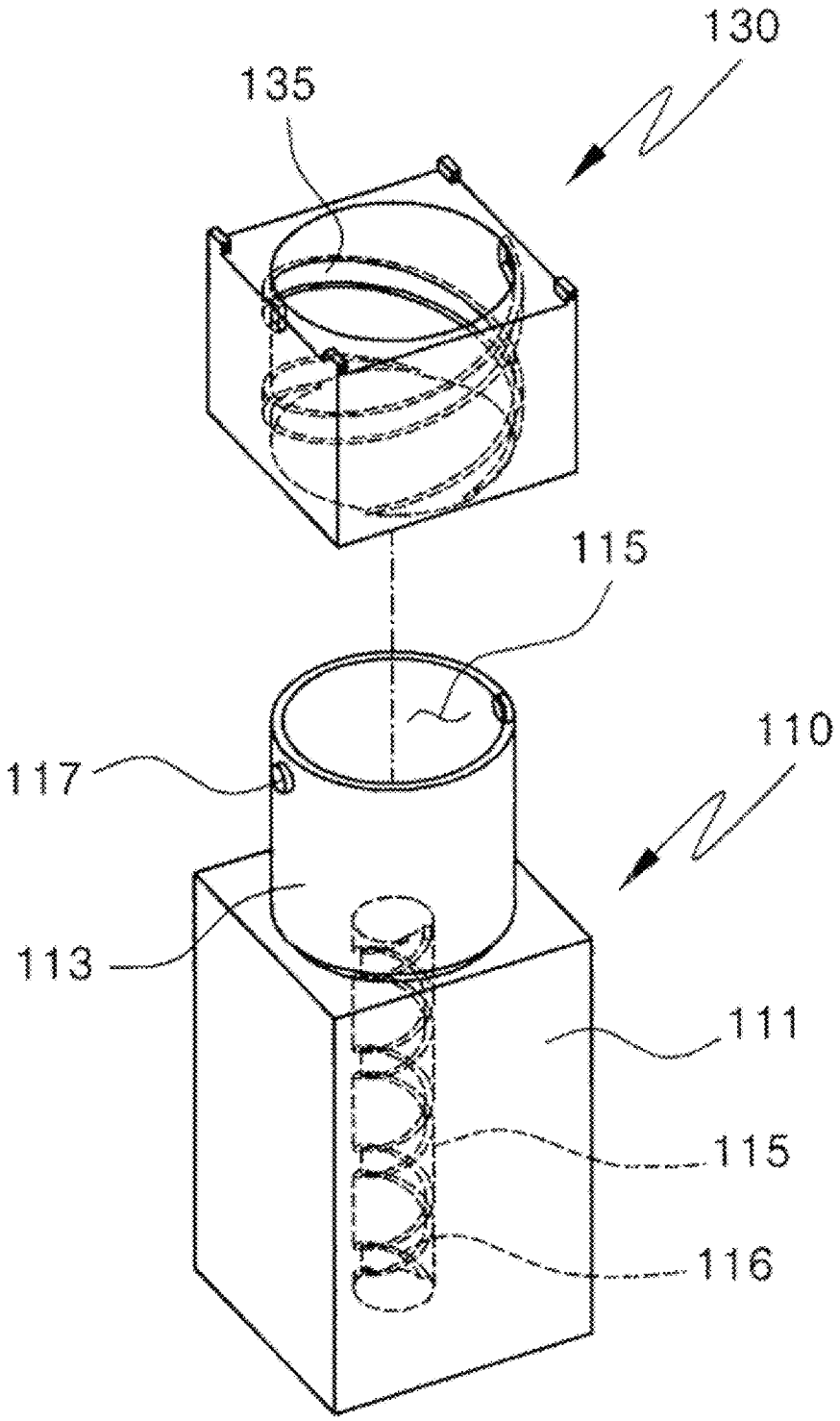
FIG. 17 is an exploded perspective view showing an example of forming screw protrusions on the outer side of the container main body and a screw guide groove on the inner side of the cover holder.

FIG. 17 is an exploded perspective view showing an example of forming screw protrusions on the outer side of the container main body and a screw guide groove on the inner side of the cover holder.

According to the present patent application shown in the figure, holder inner circumferential protrusions 117 are formed on the outer side of the cylinder 113 of the container main body 110 and a holder inner circumferential guide groove 135 in which the holder inner circumferential screw protrusions 117 are spirally fitted is formed on the inner side of the cover holder 130.

This combination structure can be applied to the embodiments of the present patent application shown in FIGS. 1 to 16 or other embodiments.

The present patent application described above provides convenience for users and makes it possible to use the lipstick container with one hand by forming the container main body 110 and the container cover 120 at a similar height or forming the container main body 110 at a slightly large height.

That is, according to the present patent application, a user can easily grip the container main body 110 with the palm, and in this position, the user can easily make up by rotating the container cover 120 with the thumb etc. to protrude the lipstick housing 150 and the lipstick.

Figure 18:
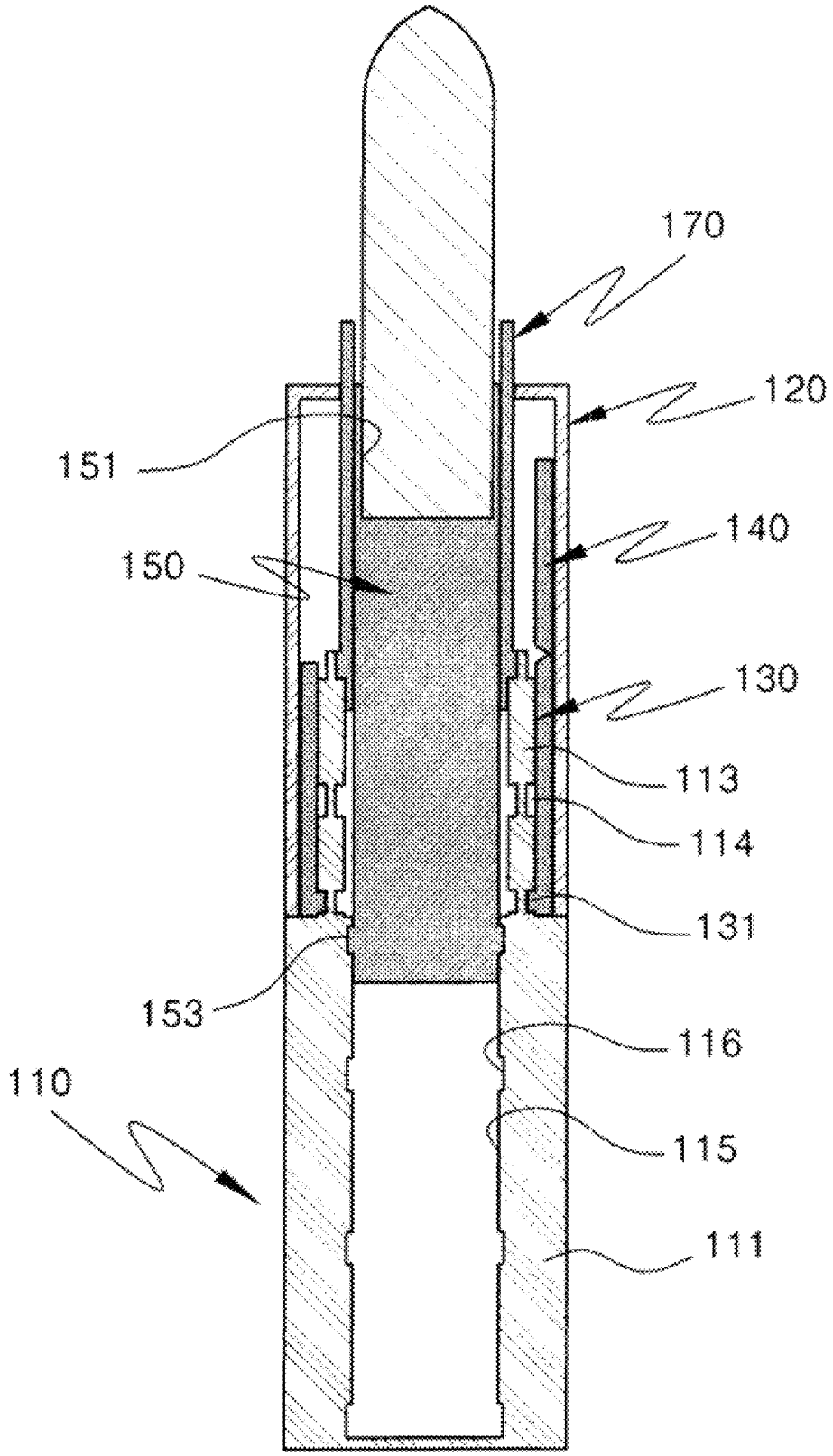
FIG. 18 is an assembly cross-sectional view showing an example of disposing a cylinder member between the container main body and the lipstick housing.
Figure 19A:
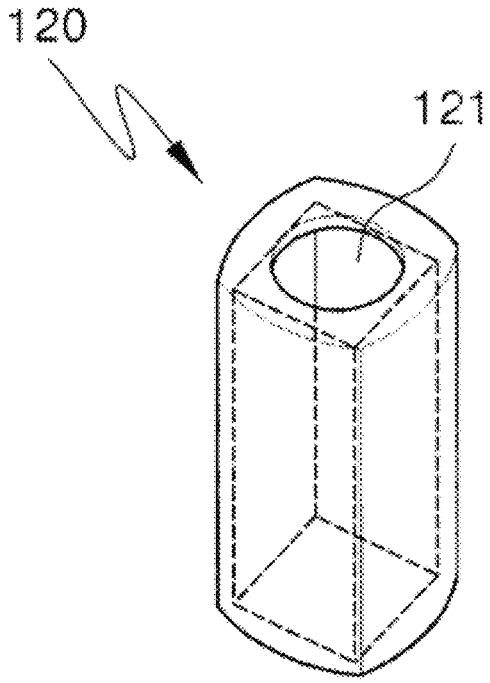
FIGS. 19A to 19D are perspective views showing modified embodiments of the container cover of a one-hand lipstick container according to the present patent application.
Figure 19B:
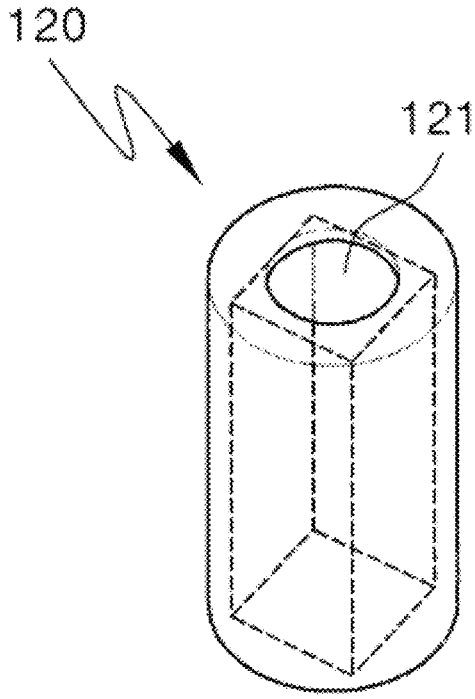
Figure 19C:
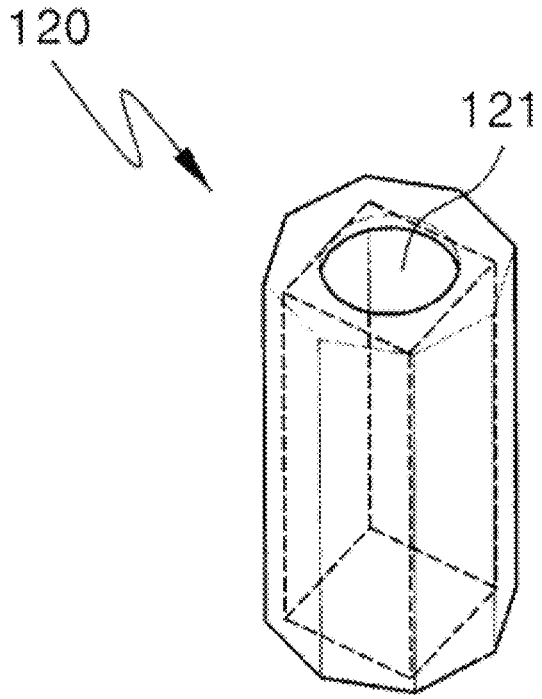
Figure 19D:
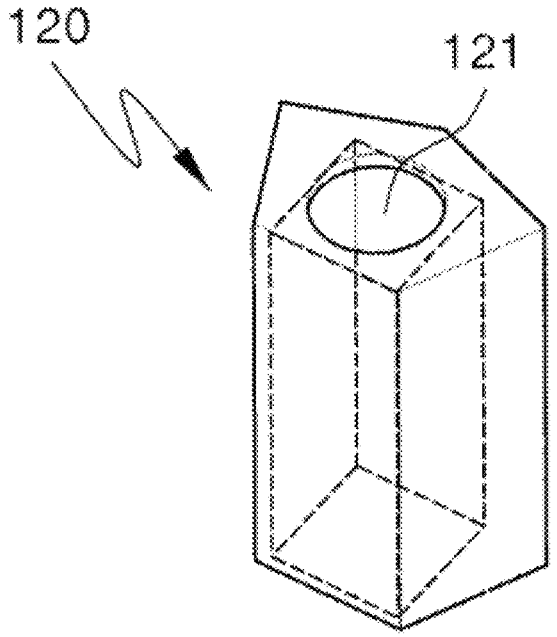

FIG. 18 is an assembly cross-sectional view showing an example of disposing a cylinder member between the container main body and the lipstick housing.

The lipstick container according to the present patent application shown in the figure can be configured such that a spiral guide groove is formed on the inner side of the upper portion of the center through-hole 115, a cylinder member 170 that ascends/descends along the spiral guide groove is disposed between the container main body and the lipstick housing 150, and the lipstick housing 150 that vertically ascends/descends is disposed inside the cylinder member 170.

In this configuration, the cylinder member 170 is formed in a pipe shape and ascends first to the uppermost portion of the center through-hole 115 to protrude through the inlet 121 of the container cover 120 before the lipstick housing 150 ascends, and then the lipstick housing 150 ascends second over the cylinder member 170 such that the lipstick protrudes.

This is for preventing a problem that the door 140 interferes with the lipstick.

Further, according to the present patent application described above, it is possible to form a spiral guide groove (not shown) on the inner side of the upper portion of the center through-hole 115 of the container main body 110 such that the cover holder 130 ascends/descends while being spirally fitted in the spiral guide groove. Accordingly, the cover holder 130 moves inside the center through-hole 115, such that it is possible to lower the lowermost position and the uppermost position in the movement section, and accordingly, it is possible to maximally use the upper space of the container cover 120.

FIGS. 19A to 19D are perspective views showing modified embodiments of the container cover of a one-hand lipstick container according to the present patent application, and in the figures, although only the shape of the container cover 120 is shown, the shape of the container main body 110 is also applied.

It is possible to form the outer shape of the container cover 120 using N straight or curved surfaces. The N is a number from 3 to the infinity and the shape corresponding to the infinity may be a circle. Further, it is preferable to form the inside of the container main body 110 and the container cover 120 in a rectangular shape.

Further, it is possible to form the inlet 121 at the upper portion of the container cover 120 in a different shape from the cross-sectional shape of the lipstick. That is, when the cross section of the lipstick is a circle, the inlet 121 can be manufactured in a polygonal shape etc.

Although it is possible to manufacture the container main body 110 and the container cover 120 of the lipstick container of the present patent application described above with synthetic resin, metal, or ceramic, when they are made of metal, such as aluminum, it is possible to improve the quality of a product due to the peculiar luster and the feel of metal.

In particular, using metal can decease the thickness of a product, such that it is possible to decrease the entire size of the product, which contributes to refine the image of the product. The present patent application having the configurations described above makes it possible to use the lipstick container with one hand, such that the use is simple and a good appearance is provided.

Further, since all the parts are assembled in the container cover and the container main body and the parts are hot exposed to the outside, elegant design can be accomplished even if the lipstick container is manufactured to have the same external appearance as existing lipstick containers. In addition, since the lipstick container is used by rotating the container main body, similar to existing lipstick containers, users can familiarly use it, without strangeness.

Further, according to the present patent application, by optimizing the height of the container main body such that a user can take all action with the lipstick container in one hand, it is possible to easily rotate the container cover with fingers while gripping the container main body with the palm, such that the use is convenient.

Figure 20:
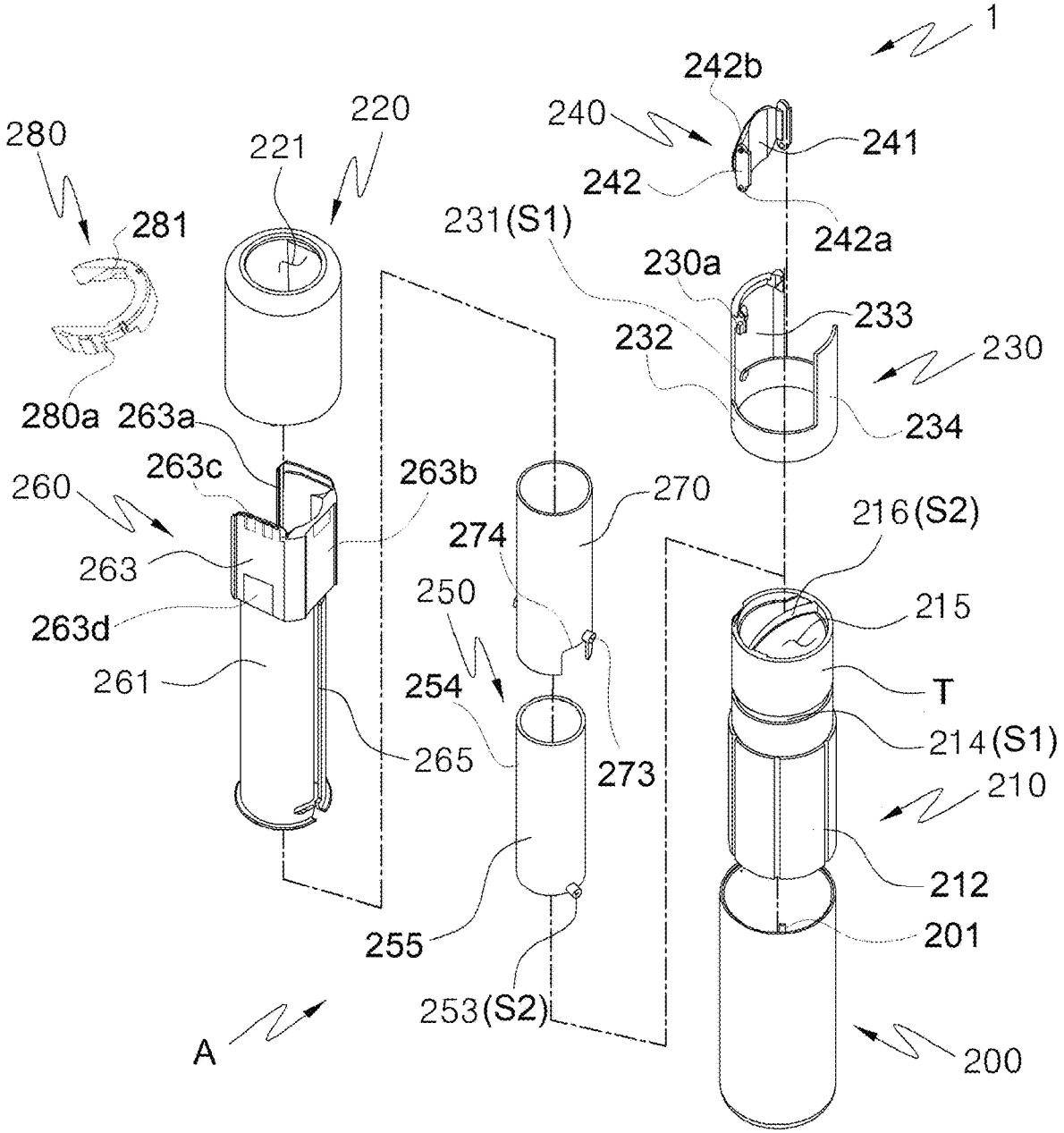
FIG. 20 is an exploded view of a one-hand lipstick container according to further embodiments of the present disclosure.
Figure 21A:
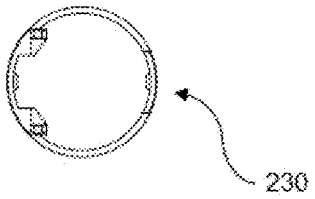
FIGS. 21A, 21B, 21C, 21D, and 21E are a top plan view, a side devotional view, a bottom plan view, a cross-sectional view, and a perspective view, respectively, of a cover holder included in the one-hand lipstick container of FIG. 20.
Figure 21B:
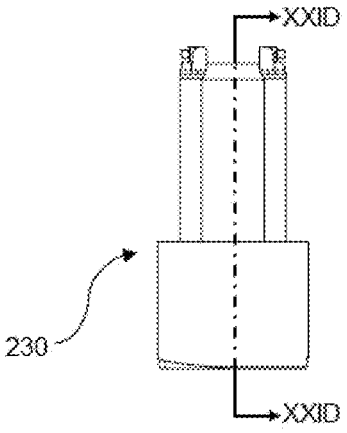
Figure 21C:
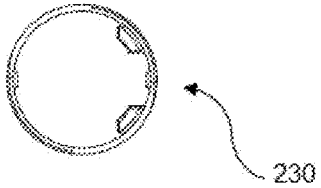
Figure 21D:
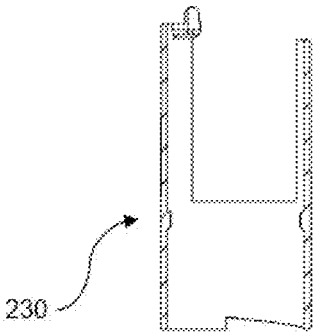
Figure 21E:
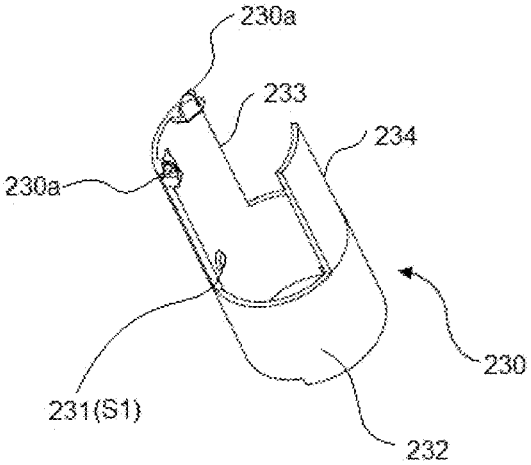
Figure 22A:
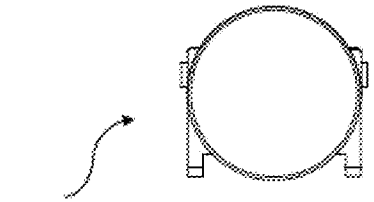
FIGS. 22A, 22B, 22C, 22D, and 22E are a top plan view, a side elevational view, a bottom plan view, a top perspective view, and a bottom perspective view, respectively of a cover included in the one-hand lipstick container of FIG. 20.
Figure 22B:
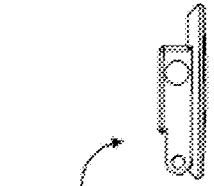
Figure 22C:
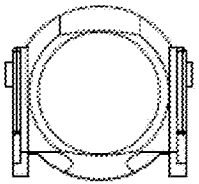
Figure 22D:
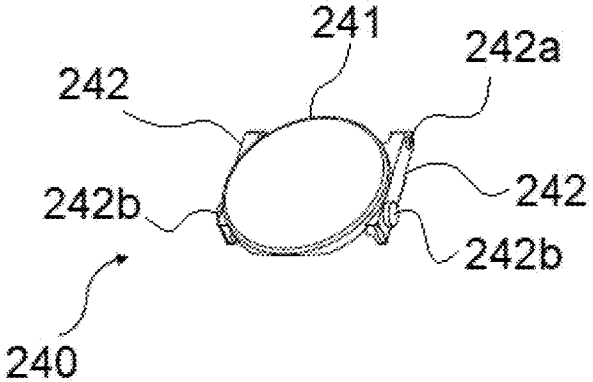
Figure 22E:
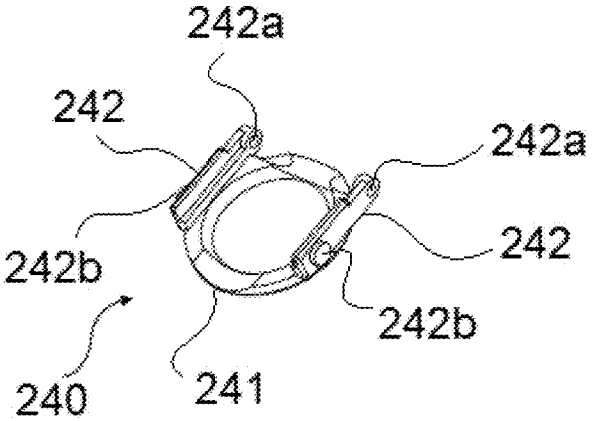
Figure 23A:
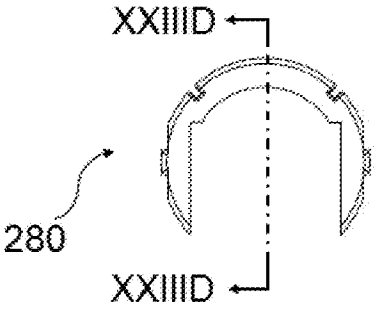
FIGS. 23A, 23B, 23C, 23D, 23E, and 23F are a top plan view, a side elevational view, a bottom plan view, a cross-sectional view, a top perspective view, and a bottom perspective view, respectively, of a cover guide included in the one-hand lipstick container of FIG. 20.
Figure 23B:
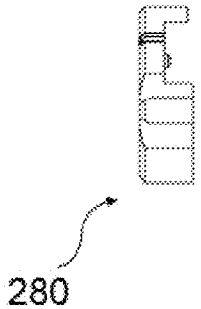
Figure 23C:
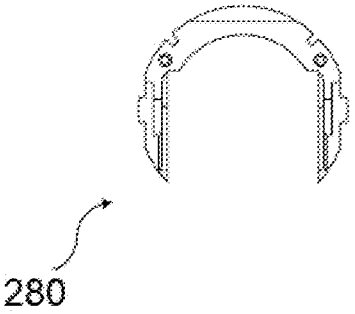
Figure 23D:
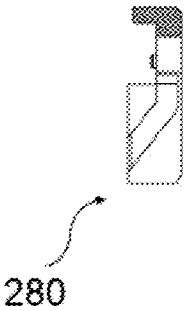
Figure 23E:
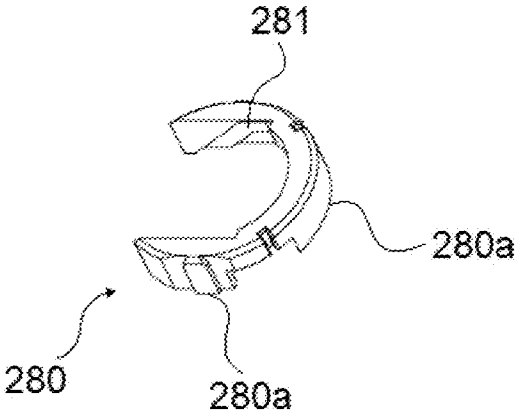
Figure 23F:
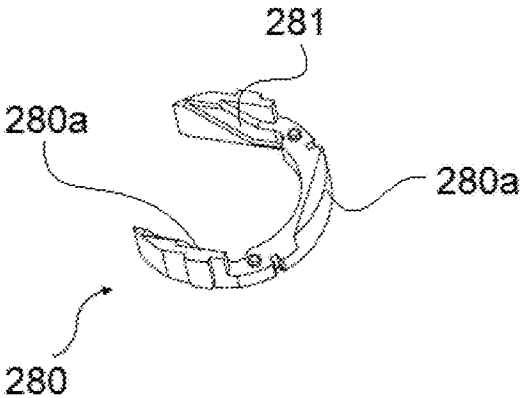
Figure 24A:
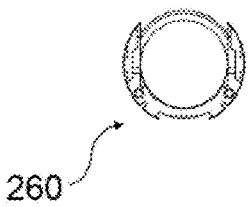
FIGS. 24A, 24B, 24C, 24D, and 24E are a top plan view, a front elevational view, a side elevational view, a cross-sectional view, and a perspective view, respectively, of an intermediate member included in the one-hand lipstick container of FIG. 20.
Figure 24B:
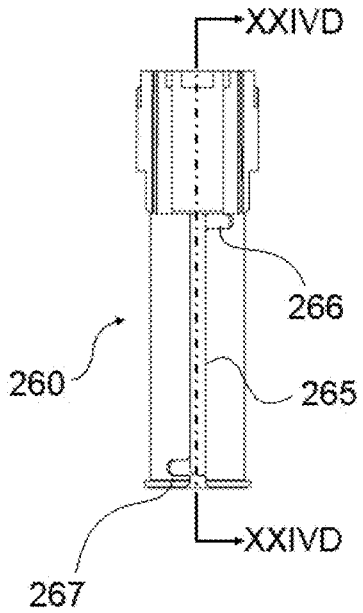
Figure 24C:
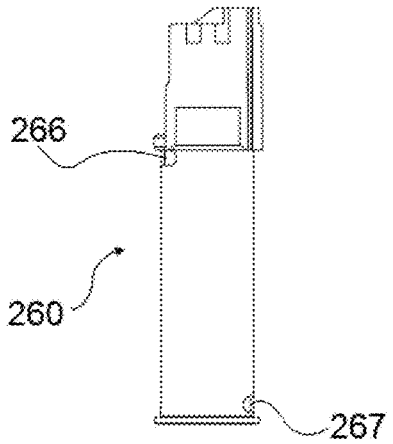
Figure 24D:
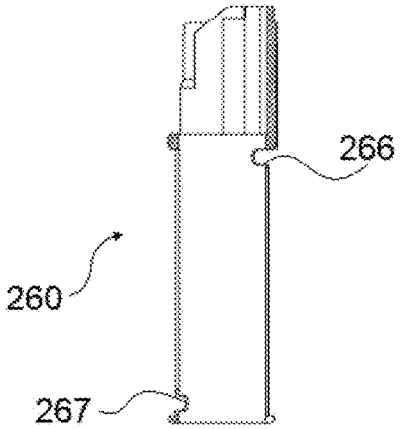
Figure 24E:
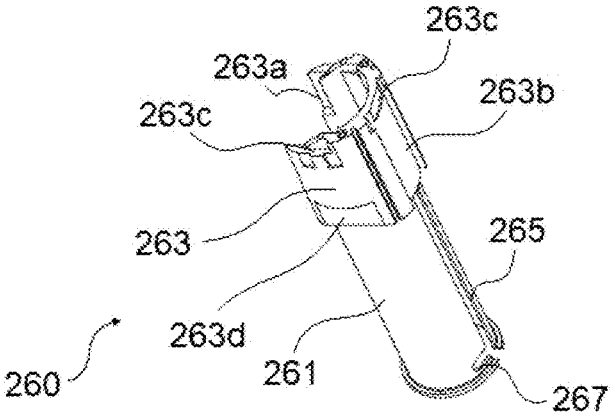
Figure 25A:
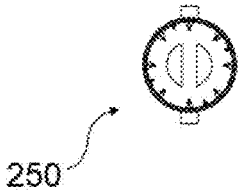
FIGS. 25A, 25B, 25C, 25D, and 25E are a top plan view, a side elevational view, a bottom plan view, a cross-sectional view, and a perspective view, respectively, of a lipstick housing included in the one-hand lipstick container of FIG. 20.
Figure 25B:
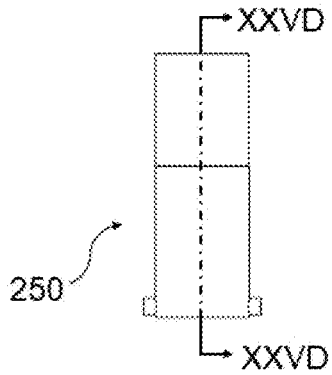
Figure 25C:
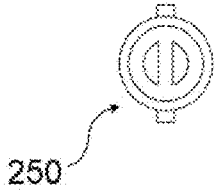
Figure 25D:
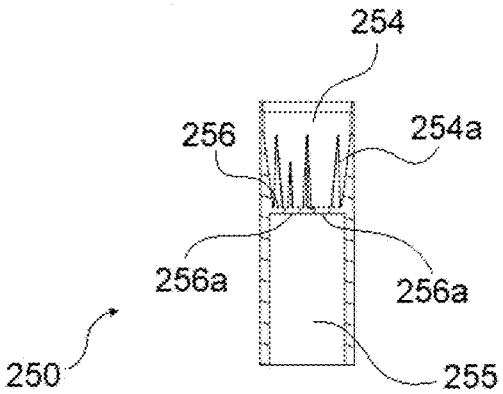
Figure 25E:
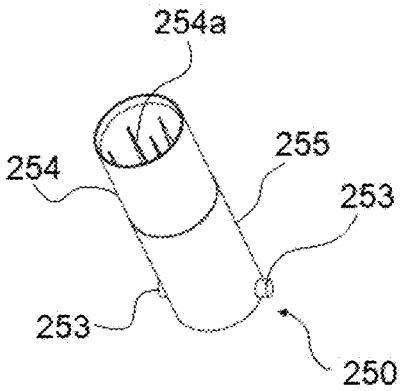
Figure 26A:
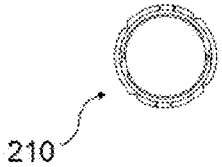
FIGS. 26A, 26B, 26C, 26D, 26E, and 26F are a top plan view, a front elevational view, a bottom plan view, a side elevational view, a cross-sectional view, and a perspective view, respectively, of a cylindrical main body 210 included in the one-hand lipstick container of FIG. 20.
Figure 26B:
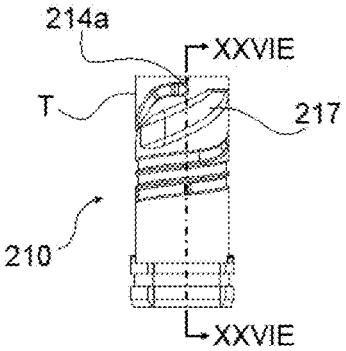
Figure 26C:
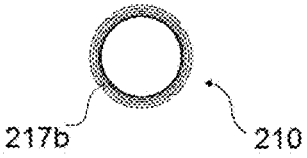
Figure 26D:
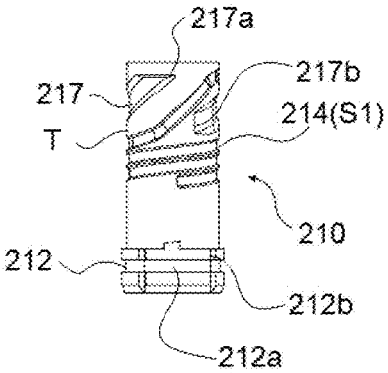
Figure 26E:
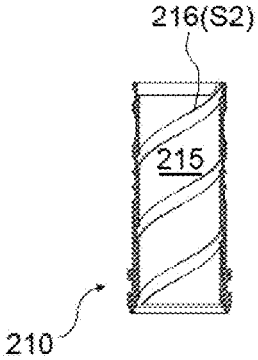
Figure 26F:
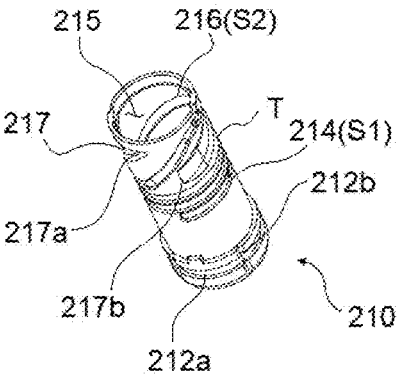
Figure 27A:
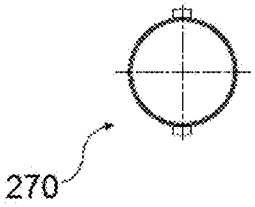
FIGS. 27A, 27B, 27C, 27D, and 27E are a top plan view, a front elevational view, a bottom plan view, a cross-sectional view, and a perspective view, respectively, of a cylinder member included in the one-hand lipstick container of FIG. 20.
Figure 27B:
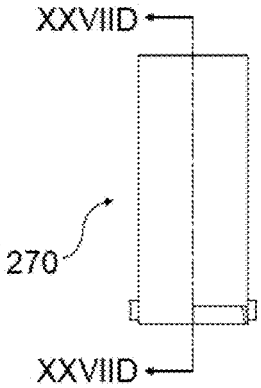
Figure 27C:
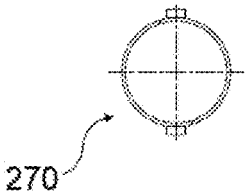
Figure 27D:
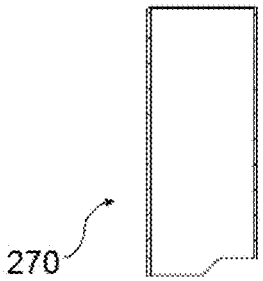
Figure 27E:
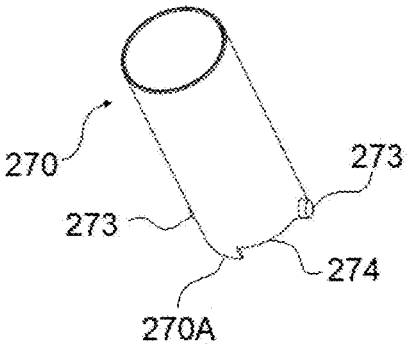

Referring now to FIG. 20, a one hand lipstick container 1 according to further embodiments of the present disclosure is described.

The one-hand lipstick container 1 comprises an internal assembly A including a cylindrical main body 210 defining an opening (or center through-hole) 215 therethrough; a cover holder 230 arranged radially outside the cylindrical main body 210; a cover (or door) 240 attached to the cover holder 240; a lipstick housing 250 arranged radially inside the cylindrical main body 210; an intermediate member (or anti-rotation means) 260 interposed radially between the cylindrical main body 210 and the lipstick housing 250. The internal assembly A further includes a cover guide 280 attached to the intermediate member 260. A cylinder member 270 may also be arranged radially inside the cylindrical many body 210. The internal assembly A is accommodated in a space defined by an upper case (or container cover) 220 and a bottom case 200 disposed in a rotatable relationship with each other at upper and lower ends, respectively, of the one-hand lipstick container 1.

Components of the one-hand lipstick container 1 depicted in FIG. 20 and subsequent drawings are amenable to variations and may incorporate features of related components in one or more embodiments described above With reference to FIGS. 1 to 19D. Except where noted otherwise, similar or analogous features may be shared by corresponding structures in different examples, such as, for example, the cylindrical main body 210 and the container main body 110; the upper case 220 and the container cover 120; the cover holder 230 and the cover holder 130; the cover 240 and the door 140; the lipstick housing 250 and the lipstick housing 150; the intermediate member 260 and the anti-rotation means 160; and the cylinder member 270 and the cylinder member 170.

In the one-hand lipstick container 1, the cylindrical main body 210 extends in an axial direction. The cover holder 230 is rotatable received on an outer circumferential surface of the cylindrical main body 210 via a first screw mechanism S1 therebetween. The cover 240 is hinged to the cover holder 230 to open and close an opening 221 at an upper end of the one-hand lipstick container 1. The lipstick housing 250 is rotatably received on an inner circumferential surface of the cylindrical main body 210 via a second screw mechanism S2 therebetween. The first screw mechanism S1 and the second screw mechanism S2 have opposite rotational directionalities to each other.

The intermediate member 260 is interposed radially between the cylindrical main body 210 and the lipstick housing 250, and includes a head 263 and a guide sleeve 261 extending from the head 263. The head 263 slidably engages with the cover holder 230 to limit rotation of the cover holder 230 relative to the intermediate member 260 while allowing the cover holder 230 to move in the axial direction relative to the intermediate member 260. The guide sleeve 261 slidably engages with the lipstick housing 250 to limit rotation of the lipstick housing 250 relative to the intermediate member 260 while allowing the lipstick housing 250 to move in the axial direction relative to the intermediate member 260.

The upper case 220 is affixed to the intermediate member 260. The bottom case 200 is affixed to the cylindrical main body 210.

The cover guide 280 is attached to the head 263 of the intermediate member 260. The cover guide 280 includes a cover guide groove 281 along which the cover 240 is guided. The cover guide 280 is provided separately from the upper case 220 and the head 263 of the intermediate member 260.

With additional reference to FIGS. 21A through 32E, respective components of the one-hand lipstick container 1 are depicted in further detail.

FIGS. 21A, 21B, 21C, 21D, and 21E are a top plan view, a side elevational view, a bottom plan view, a cross-sectional view, and a perspective view, respectively, of the cover holder 230.

In some embodiments, the cover holder 230 may include an annular base 232; a first sliding part 233 extending from the annular base 232; and a second sliding part 234 extending from the annular base 232, disposed radially opposite the first sliding part 233. A first protrusion 231 may be provided on an inner circumferential surface of the cover holder 230.

The annular base 232 may have a diameter larger than that of an upper portion of the cylindrical main body 210 where a threaded surface T is provided. Each of the first sliding part 233 and the second sliding part 234 may be curved along a corresponding section of the circumference of the annular base 232. Each of the first sliding part 233 and the second sliding part 234 may define a pair of parallel edges along the axial direction. The first sliding part 233 may be longer in the axial direction, and wider in the circumferential direction, than the second sliding part 234. A pair of hinge pins 230*a* may be provided on an upper end of the first sliding part 233.

FIGS. 22A, 22B, 22C, 22D, and 22E are a top plan view, a side elevational view, a bottom plan view, a top perspective view, and a bottom perspective view, respectively, of the cover 240.

In some embodiments, the cover 240 may include a lid 241 with a pair of legs 242 extending from opposite sides of the lid 241. The lid 241 may be in any suitable shape, such as a circle or a polygon, that conforms to the perimeter of the opening 221. A pair of holes 242*a* may be provided in the pair of legs 242, so as to accommodate the pair of hinge pins 230*a* provided on the cover holder 230. A pair of cover protrusions 242*b* may be provided on the pair of legs 242, so as to slidably engage with a pair of cover guide grooves 281 provided on the cover guide 280.

FIGS. 23A, 23B, 23C, 23D, 23E and 23F are a top plan view, a side elevational view, a bottom plan view, a cross-sectional view, a top perspective view, and a bottom perspective view, respectively, of the cover guide 280.

In some embodiments, the cover guide 280 may comprises a curved, open-ended ring defining a U-shaped configuration having a pair of parallel inner surfaces opposite each other, on which a pair of cover guide grooves 281 are provided. A distance between the cover guide grooves 281 may be determined based on a distance between opposite sides of the cover 240 where the pair of cover protrusions 242*b* are provided, such that the pair of cover protrusions 242*b* slidably engage with the pair of cover guide grooves 281 in the assembled container 1. Different configurations of the cover guide 280 are possible than those depicted the figures. For example, the cover guide 280 may have a closed ring configuration without discontinuation in the circumference, or a rectangular ring or U-shaped configuration.

In some embodiments, attachment of the cover guide 280 to the head 263 of the intermediate member 260 may be accomplished, for example, by a combination of complementary recess and projection provided on the cover guide 280 and the head 263, respectively. For example, one or more recesses 263*c* may be provided on the head 263, and one or more projections 280*a* may be provided on the cover guide 280, such that fitting the recesses 263*c* and the projections 280*a* secures the cover guide 280 in place relative to the head 263 of the intermediate member 260. A dimension of the cover guide 280 may be equal to or slightly smaller than a gap between opposing surfaces of the upper case 220 and the head 263 of the intermediate member 260, such that the cover guide 280 is fixed in place between the upper case 220 and the head 263 once the one-hand lipstick container 1 is assembled.

Compared to embodiments where a cover guide groove is provided on an inner surface of the upper case or the intermediate member, provision of the cover guide 280 separate from the upper case 220 and the intermediate member 260 may facilitate assembly of the one-hand lipstick container 1, wherein attachment of the cover 240 to the cover holder 230 and positioning of the cover 240 relative to the cover guide 280 may be performed in separate production steps without interfering with the surrounding structures, which ultimately results in improved precision in the assembly, and consequently, high production yield and reliable performance of the resulting container 1.

FIGS. 24A, 24B, 24C, 24D, and 24E are a top plan view, a front elevational view, a side elevational view, a cross-sectional view, and a perspective view, respectively, of the intermediate member 260.

In some embodiments, the head 263 and the guide sleeve 261 of the intermediate member 260 may be formed of an integral piece of material, such as molded plastic. Alternatively, instead, the head 263 and the guide sleeve 261 of the intermediate member 260 may be formed of separate pieces of material fastened together to restrict movement with respect to each other.

In some embodiments, the head 263 of the intermediate member 260 and the cover holder 230 may have mutually complementary shapes configured to together define a continuous circumferential surface in direct contact with an inner circumferential surface of the upper case 220. The continuous circumferential surface may be any suitable shape, such as a circle, an ellipse, a polygon, a curved polygon, a polygon with rounded corners, or any combination thereof, in cross section. For example, the continuous circumferential surface may have a horizontal cross section shaped as a curved square or a square with rounded corners.

In some embodiments, the head 263 of the intermediate member 260 may include a first vertical guide portion 263*a* configured to receive the first sliding part 233 of the cover holder 230 slidably therealong in the axial direction; and a second vertical guide portion 263*b*, disposed opposite the first vertical guide portion 263*a*, configured to receive the second vertical guide portion 263*b* of the cover holder 230 slidably therealong in the axial direction.

Specifically, the first vertical guide portion 263*a* may be provided as a cut having a width similar to that of the first sliding part 233 of the cover holder 230. The second vertical guide portion 263*b* may be provided as a recessed surface having a width similar to that of the second sliding part 234 of the cover holder 230. For example, the head 263 may have a U-shaped cross section wherein the gap in letter U corresponds to the vertical guide portion 263 into which the first sliding part 233 of the cover holder 230 slidably fits, whereas the side opposite the gap in letter U corresponds to the second vertical guide portion 263*b* along which the second sliding part 234 of the cover holder 230 slidably fits.

In some embodiments, the head 263 of the intermediate member 260 may have an outer circumferential surface thereof configured to interlock with an inner circumferential surface of the upper case 220. For example, a pair of horizontal grooves 263*d* may be provided on opposite sides of the outer circumferential surface of the head 263, and a pair of projections 220*a* (see FIGS. 31A-31E) may be provided on opposite sides of the inner circumferential surface of the upper case 220, such that fitting the projections 220*a* in the horizontal grooves 263*d* fastens the intermediate member 260 onto the upper case 270.

In some embodiments, the guide sleeve 261 of the intermediate member 260 may comprise an elongated cylinder with a first guide slot 265 defined therein. The outermost diameter of the guide sleeve 261 may be determined based on the respective sizes of the surrounding structures including the cylindrical main body 210, the cover holder 230, the lipstick housing 250, and the cylinder member 270.

In some embodiments, the guide sleeve 261 may include a first horizontal slot 266 continuous with an upper end of the first guide slot 265 and offset from the first guide slot 265 in the axial direction, and a second horizontal slot 267 continuous with a lower end of the first guide slot 265 and offset from the first guide slot 265 in the axial direction. The second horizontal slot 267 extends horizontally in a direction opposite to the first horizontal slot 266.

Unlike embodiments where a fixed end 163 at the upper end of the pipe body 161 is fitted inside the cover holder 130 and receives rotational force therefrom, the head 263 of the intermediate member 260 is disposed outside of the cover holder 230, and is directly connected to the upper case 220 so as to receive rotational force therefrom. Compared to embodiments where the anti-rotation means is disposed inside the cover holder, the intermediate member 260 allowing direct connection between the head 263 and the upper case 220 may contribute to size reduction and increased design flexibility of the one-hand lipstick container 1, where, for example, the overall thickness of the one-hand lipstick container 1 is reduced by reducing the number of overlapping layers of material, and exposing the head 263 to the upper case 220 allows for diverse configurations of anti-rotation and cover guide functionalities in the one-hand lipstick container 1.

FIGS. 25A, 25B, 25C, 25D, and 25E are a top plan view, a side devotional view, a bottom plan view, a cross-sectional view, and a perspective view, respectively, of the lipstick housing 250.

In some embodiments, the lipstick housing 250 may include an upper, housing portion 254 configured to accommodate a lipstick therein, and a lower, base portion 255 divided from the housing portion 254 by an internal partition 256. A plurality of ridges 254*a* may be provided on an inner circumferential surface of the housing portion 254, so as to secure a lipstick in place in an assembled product. Ventilation holes 256*a* may be provided in the partition 256, so as to allow for air communication between the housing portion 254 and the base portion 255. The lipstick housing 250 may further include a pair of second protrusions 253 provided on an outer circumferential surface thereof adjacent to a lower end of the base portion 255.

FIGS. 26A, 26B, 26C, 26D, 26E, and 26F are a top plan view, a front elevational view, a bottom plan view, a side elevational view, a cross-sectional view, and a perspective view, respectively, of the cylindrical main body 210.

In some embodiments, the cylindrical main body 210 may comprise a bottomed tabular member sized to accommodate the inner structures, such as the lipstick housing 250, the cylinder member 270, and the intermediate member 260, therein. Outer and/or inner circumferential surfaces of the cylindrical main body 210 may be threaded to serve as guide grooves in the screw mechanisms S1 and S2, as detailed below.

In some embodiments, the cylindrical main body 210 may have an outer circumferential surface thereof configured to interlock with an inner circumferential surface of the bottom case 200. For example, circumferential grooves 212 may be provided on the outer circumferential surface of the cylindrical main body 210, and corresponding projections 201 may be provided on the inner circumferential surface, of the bottom case 200, such that fitting the projections 201 in the circumferential grooves 212 fastens the cylindrical main body 210 onto the bottom case 200.

The circumferential grooves 212 may include a plurality of vertical grooves 212 intermittently disposed along the circumference of the cylindrical main body 210, as depicted in FIG. 20. Alternatively, instead, the circumferential grooves 212 may include a combination of an annular groove 212*a* and one or more vertical grooves 212*b* intermittently disposed along the circumference of the cylindrical main body 210, as depicted in FIGS. 26A through 26F.

With further reference to FIG. 20 and FIGS. 21A to 21E, 25A to 25E, and 26A to 26F, the first and second screw mechanisms S1 and S2 are described.

In some embodiments, the first screw mechanism S1 may include a first helical guide groove 214 provided on a threaded surface T being one of the outer circumferential surface of the cylindrical main body 210 and an inner circumferential surface of the cover holder 230, and a first protrusion 231 provided on the other one of the outer circumferential surface of the cylindrical main body 210 and the inner circumferential surface of the cover holder 230 to slidably engage with the first helical guide groove 214.

For example, in the example depicted in FIG. 20, the first helical guide groove 214 is provided on a threaded surface T which is the outer circumferential surface of the cylindrical main body 210, and the first protrusion 231 is provided on the inner circumferential surface of the cover holder 230.

The second screw mechanism S2 may include a second helical guide groove 216 provided on the inner circumferential surface of die cylindrical main body 210, and a second protrusion 253 provided on an outer circumferential surface of the lipstick housing 250 to slidably engage with the second helical guide groove 216. The guide sleeve 261 of the intermediate member 260 may include a first guide slot 265 extending in the axial direction, through which the second protrusion 253 protrudes outward to slidably engage with the second helical guide groove 216.

The first screw mechanism S1 may include a pair of said first helical guide grooves 214, and a pair of said first protrusions 231. Likewise, the second screw mechanism S2 may include a pair of said second helical guide grooves 216, and a pair of said second protrusions 253. Each pair of guide grooves may be radially symmetrical to each other, and each pair of protrusions may be radially symmetrical to each other.

The first helical guide groove 214 and the second helical guide groove 216 spiral in opposite directions, such that sliding the first protrusion 231 along the first helical guide groove 214 causes the cover holder 230 to move in a first vertical direction along the axial direction while rotating relative to the cylindrical main body 210, and sliding the second protrusion 253 along the second helical guide groove 216 causes the lipstick housing 250 to move in a second vertical direction, opposite the first vertical direction, along the axial direction while rotating relative to the cylindrical main body 210.

The terms "first vertical direction" and "second vertical direction" as used herein refer to directions in which the cover holder 230 and the lipstick housing 250, respectively, are movable along the axial direction as the first protrusion 231 and the second protrusion 253 slide along the first helical guide groove 214 and the second helical guide groove 216, respectively, in response to a torque or rotational force applied by a user twisting the upper case 220 relative to the bottom case 200. The term "axial direction" as used herein corresponds to a direction in which the cylindrical main body 210 extends. The term "upward movement" or "ascent" as used herein generally indicates a movement toward an upper end of the one-hand lipstick container 1 where the opening 221 may be located, and the term "downward movement" or "descent" as used herein generally indicates a movement toward a lower end of the one-hand lipstick container 1 where the bottom of the bottom case 200 may be located. For example, twisting the upper case 220 clockwise relative to the bottom case 200 may cause the cover holder 230 to move downward (i.e., descend) and the lipstick housing 250 to move upward (i.e., ascend) along the axial direction, whereas twisting the upper case 220 counterclockwise relative to the bottom case 200 may cause the cover holder 230 to move upward (i.e., ascend) and the lipstick housing 250 to move downward (i.e., descend) along the axial direction.

With continued reference to FIGS. 26A through 26F, variations of the first screw mechanism S1 according to the present disclosure are described.

In some embodiments, the first screw mechanism S1 may further include an auxiliary guide groove 217 disposed adjacent to an upper end 214*a* of the first helical guide groove 214. The auxiliary guide groove 217 is separate from the first helical guide groove 214, and is configured to receive the first protrusion 231 therein. The upper end 214*a* of the first helical guide groove 214 may be located inward from an upper perimeter of the threaded surface T.

During operation of the one-hand lipstick container 1, after the first protrusion 231 reaches the upper end 214*a* of the first helical guide groove 214, an additional torque applied in a direction to open the one-hand lipstick container 1 causes the first protrusion 231 to disengage from the upper end 214*a* of the first helical guide groove 214 and glide over the threaded surface T into the auxiliary guide groove 217.

In some embodiments, the auxiliary guide groove 217 may be wider than the first protrusion 231 along a circumferential direction of the threaded surface T. Also, the auxiliary guide groove 217 may be wider than the first protrusion 231 along the axial direction. Further, the auxiliary guide groove 217 may extend diagonally to the axial direction, so as to generally follow the contour of the first helical guide groove 214.

In some embodiments, an upper end 217*a* of the auxiliary guide groove 217 may taper to a pointed tip, so as to restrict further movement of the first protrusion 231 away from the upper end 217*a* of the auxiliary guide groove 217 in response to a torque applied in a direction to open the one-hand lipstick container 1.

In some embodiments, a lower end 217*b* of the auxiliary guide groove 217 may have a gradually reduced depth to be level with the threaded surface T, so as to allow the first protrusion 231 to exit the auxiliary guide groove 217 to reengage with the first helical guide groove 214 in response to a torque applied in a direction to close the one-hand lipstick container 1.

Providing the auxiliary guide groove 217 separate from the first helical guide groove 214 may allow for reliable operation of the one-hand lipstick container 1, reducing a risk of misalignment or damage where the first screw mechanism S1 undergoes idle rotation so as to absorb a difference in circumferential length between the first helical guide groove 214 and the second helical guide groove 216. The pointed tip at the upper end 217*a* of the auxiliary guide groove 217 securely limits further rotation of the cover holder 230 once it reaches a predetermined height to establish a closed state of the container 1, and the gradually reduced depth at the lower end 217*b* of the auxiliary guide groove 217 enables smooth reengagement of the first protrusion 231 with the first helical guide groove 214 in response to reverse rotation to open the one-hand lipstick container 1.

FIGS. 27A, 27B, 27C, 27D, and 27E are a top plan view, a front elevational view, a bottom plan view, a cross-sectional view, and a perspective view, respectively, of the cylinder member 270.

In some embodiments, the cylinder member 270 may telescopically surround the lipstick housing 250. The guide sleeve 261 may slidably engage with the cylinder member 270 to limit rotation of the cylinder member 270 relative to the intermediate member 260 while allowing the cylinder member 270 to move in the axial direction relative to the intermediate member 260. Twisting the upper case 220 relative to the bottom case 210 transmits a torque to the cylinder member 270 via the intermediate member 260, causing the cylinder member 270 to move in the second vertical direction (i.e., the same direction in which the lipstick housing 250 moves), while rotating relative to the cylindrical main body 210.

In some embodiments, a third protrusion 273 may be provided on an outer circumferential surface of the cylinder member 270 to slidably engage with the second helical guide groove 216. The third protrusion 273 protrudes outward through the first guide slot 265 provided in the guide sleeve 261 of the intermediate member 260, so as to slidably engage with the second helical guide groove 216. The cylinder member 270 may include a pair of said third protrusions 273.

Sliding the third protrusion 273 along the second helical guide groove 216 causes the cylinder member 270 to move in the second vertical direction (i.e., the same direction in which the lipstick housing 250 moves) while rotating relative to the cylindrical main body 210. In response to a torque applied in a direction to open the one-hand lipstick container 1, the opening 221 is reached first by the cylinder member 270 and subsequently by the lipstick housing 250 as the cylinder member 270 and the lipstick housing 250 move upward in the axial direction.

In some embodiments, the cylinder member 270 may have a notch 274 adjacent to a bottom end 270*a* of the cylinder member 270, through which the second protrusion 253 protrudes outward to slidably engage with the second helical guide groove 216. In the example depicted in FIG. 20 and FIGS. 27A through 27E, the notch 274 has an upper end thereof located below the third protrusion 273 in the axial direction.

Figure 28:
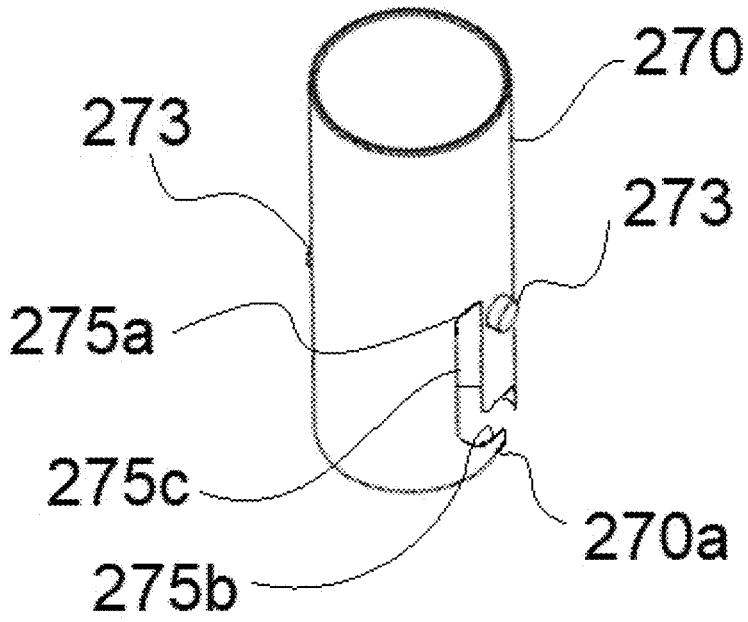
FIG. 28 is a perspective view of another example of the cylinder member provided with a second guide slot.

FIG. 28 is a perspective view of another example of the cylinder member 270.

As depicted in FIG. 28, in some embodiments, the cylinder member 270 may include a second guide slot 275 extending upward from a bottom end 270*a* of the cylinder member 270 in the axial direction, through which the second protrusion 253 protrudes outward to slidably engage with the second helical guide groove 216. An upper end 275*a* of the second guide slot 275 may be located at the same level as the third protrusion 273 in the axial direction. The third protrusion 273 may be spaced apart from the bottom end 270*a* of the cylinder member 270 in the axial direction. A distance from the upper end 275*a* of the second guide slot 275 to the bottom end 270*a* of the cylinder member 270 in the axial direction may be more than 10% of the length of the cylinder member 270 and may be from 20% to 90%, and preferably from 30% to 50%, of the length of the cylinder member 270.

In some embodiments, the second guide slot 275 may include a positioning portion 275*b* located adjacent to the bottom end 270*a* of the cylinder member 270 and aligned with the third protrusion 273 in the axial direction. The second guide slot 275 may also include a guide portion 275*c* extending from the positioning portion 275*b* and terminating in the upper end 275*a* of the second guide slot 275. The guide portion 275*c* may be offset from the third protrusion 273 in the axial direction.

Figure 29A:
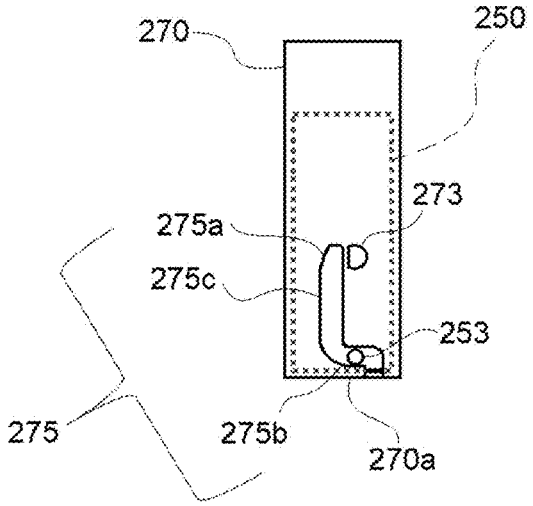
FIGS. 29A through 29C schematically illustrate the cylinder member of FIG. 28, shown with the lipstick housing during operation of the one-hand lipstick container.
Figure 29B:
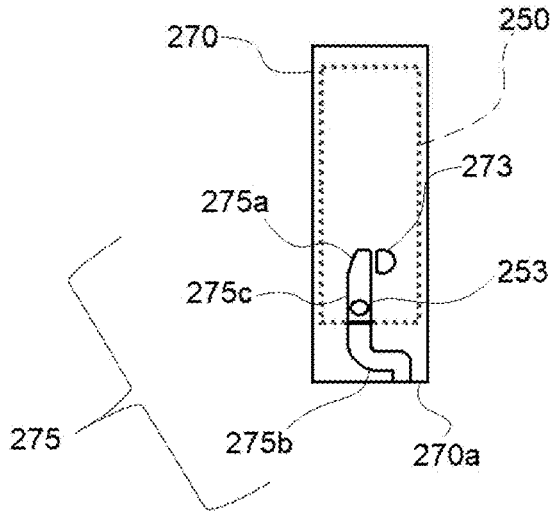
Figure 29C:
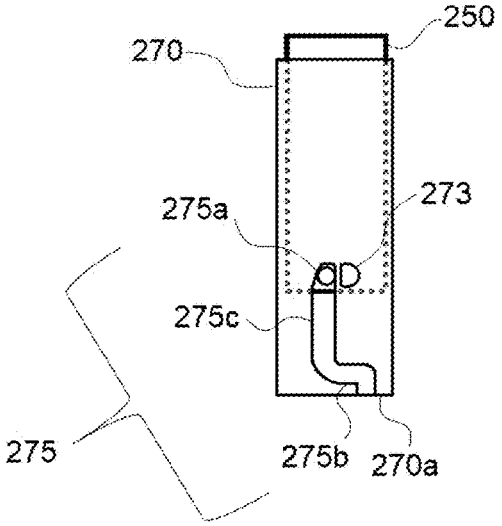

FIGS. 29A through 29C schematically illustrate the cylinder member 270 of FIG. 28, shown with the lipstick housing 250 during operation of the one-hand lipstick container 1. FIGS. 30A through 30D schematically illustrate movement of the second protrusion 253 and the third protrusion 273 with respect to the guide sleeve 261 of the intermediate member 260 during operation of the one-hand lipstick container 1, with surrounding structures omitted for clarity.

In some embodiments, the third protrusion 273 may be located higher (i.e., closer to the opening 221) than the second protrusion 253 is in the axial direction, where the one-hand lipstick container 1 is in a fully closed state. The third protrusion 273 may be located at the same level as the second protrusion 253 is in the axial direction, where the one-hand lipstick container 1 is in a fully open state. A distance between the second protrusion 253 and the third protrusion 273 in the axial direction may diminish as the one-hand lipstick container 1 is operated from the fully closed state to the fully open state.

Figure 30A:
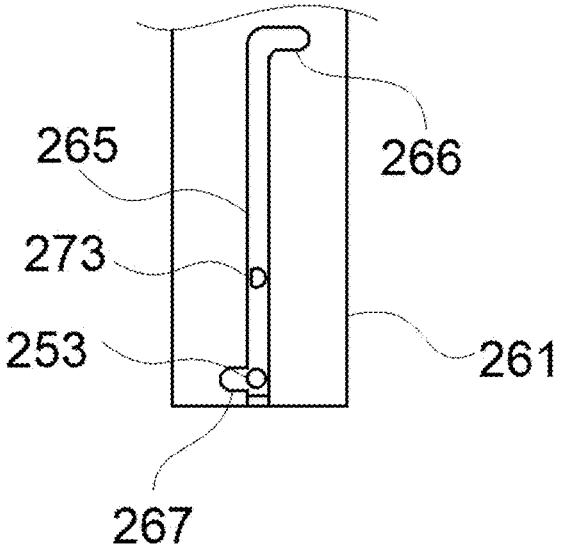
FIGS. 30A through 30D schematically illustrate movement of a second protrusion and a third protrusion with respect to a guide sleeve of the intermediate member during operation of the one-hand lipstick container, with surrounding structures omitted for clarity.

Specifically, as depicted in FIG. 29A, where the one-hand lipstick container 1 is in a fully closed state, the second protrusion 253 may be accommodated in the positioning portion 275*b* of the second guide slot 275 so as to align with the third protrusion 273 in the axial direction. Meanwhile, as depicted in FIG. 30A, both the second protrusion 253 and the third protrusion 273 may protrude outward via the first guide slot 265 of the guide sleeve 261. At this point, the first guide slot 265 aligns with the positioning portion 275*b* of the second guide slot 275 in the axial direction.

In response to a torque applied in a direction to open the one-hand lipstick container 1 in the fully closed state, the lipstick housing 250 and the cylinder member 270 move upward synchronously with each other, as their respective protrusions 253 and 273 are simultaneously guided along the first guide slot 265.

Figure 30B:
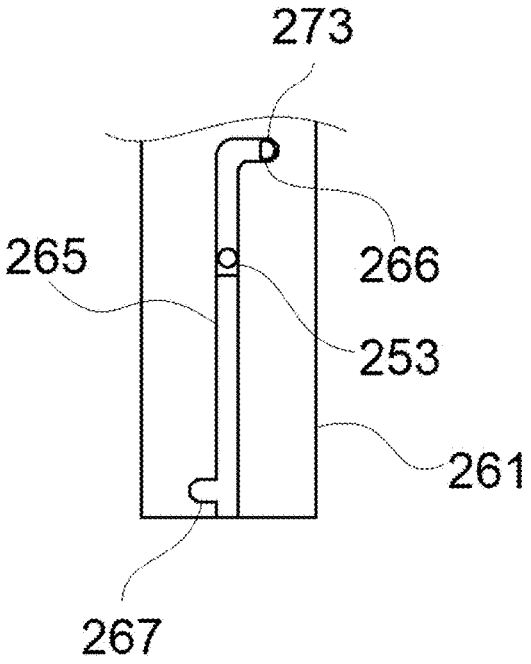

After the third protrusion 273 reaches the upper end of the first guide slot 265, a further toque applied in a direction to open the one-hand lipstick container 1 causes the third protrusion 273 to enter the first horizontal slot 266 of the guide sleeve 261 as depicted in FIG. 30B, whereas the second protrusion 253, still in the first guide slot 265, enters the guide portion 275*c* of the second guide slot 275 as depicted in FIG. 29B. At this point, the first guide slot 265 aligns with the guide portion 275*c* of the second guide slot 275 in the axial direction.

With the third protrusion 273 reaching the upper end of the first guide slot 265, the cylinder member 270 ceases upward movement, whereas the lipstick housing 250 may continue upward movement with the second protrusion 253 guided along first guide slot 265. Where the cylinder member 270 is at its highest operational position, an upper end of the cylinder member 270 may be located above the opening 221.

Figure 30C:
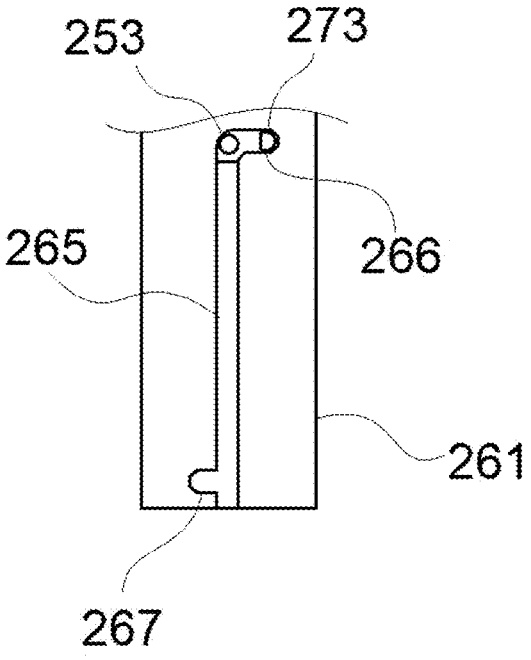

As the second protrusion 253 reaches the upper end 275*a* of the second guide slot 275, the second protrusion 253 and the third protrusion 273 may align with each other in the horizontal direction, so as to be located at the same level as each other in the axial direction, as depicted in FIG. 29C and FIG. 30C. With the second protrusion 253 reaching the upper end 275*a* of the second guide slot 275, the lipstick housing 250 ceases upward movement. Where the lipstick housing 250 is at its highest operational position, an upper end of the lipstick housing 250 may be located above the upper end of the cylinder member 270.

Figure 30D:
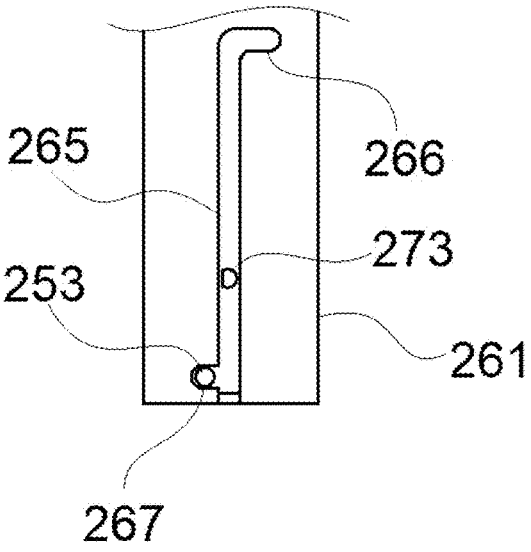
Figure 31A:
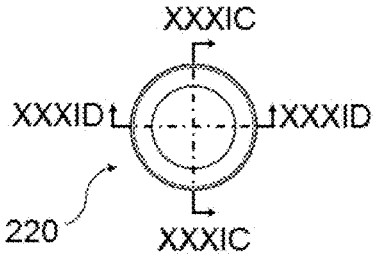
FIGS. 31A, 31B, 31C, 31D, and 31E are a top plan view, a bottom plan view, a first cross-sectional view, a second cross-sectional view, and a perspective view, respectively, of an upper case included in the one-hand lipstick container of FIG. 20.
Figure 31B:
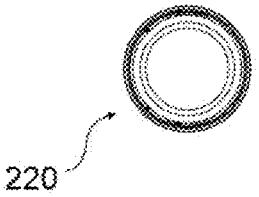
Figure 31C:
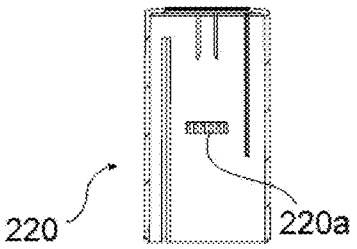
Figure 31D:
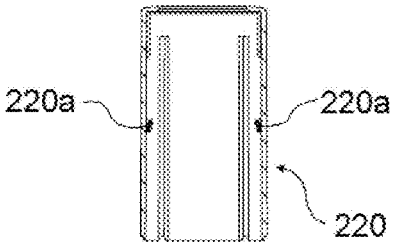
Figure 31E:
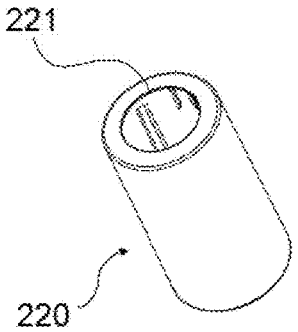
Figure 32A:
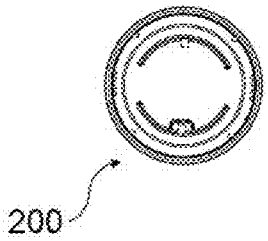
FIGS. 32A, 32B, 32C, 32D, and 32E are a top plan view, a side elevational view, a bottom plan view, a cross-sectional view, and a perspective view, respectively, of a bottom case included in the one-hand lipstick container of FIG. 20.
Figure 32B:
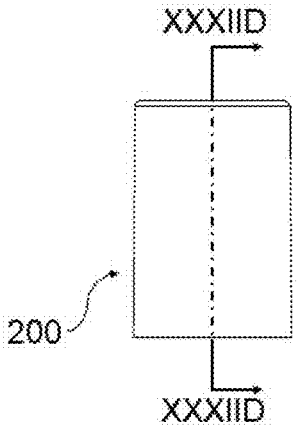
Figure 32C:
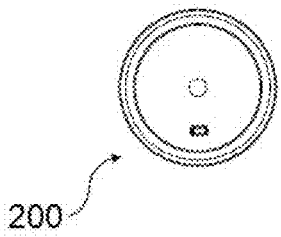
Figure 32D:
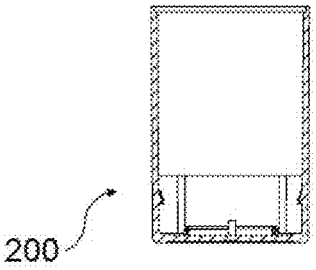
Figure 32E:
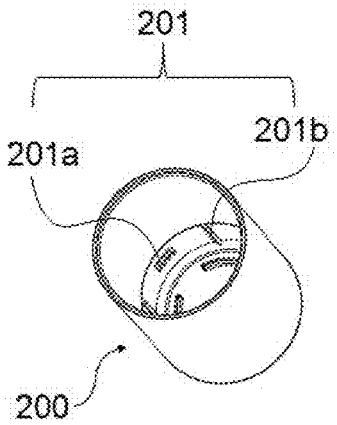

Further, in response to a torque applied in a direction to close the one-hand lipstick container 1 in a fully closed state, the second protrusion 253 enters the second horizontal slot 267 of the guide sleeve 261 via a lower end of the guide portion 275*c* of the second guide slot 275, whereas the third protrusion 273 remains within the first guide slot 265 of the guide sleeve 261, as depicted in FIG. 30D. At this point, the first guide slot 265 aligns with the positioning portion 275*b* of the second guide slot 275 in the axial direction. Where the lipstick housing 250 is at its lowest operational position, a lower end of the lipstick housing 250 may be located above a lower end of the cylinder member 270.

Provision of the cylinder member 270 ensures that the cover 240 properly opens to allow exposure of a lipstick to the outside via the opening 210 without interfering with the surrounding structures during operation of the one-hand lipstick container 1. Further, provision of the second guide slot 275 in the cylinder member 270 may increase a range of mobility of the lipstick housing 250 while inside the cylinder member 270, which in turn allows for a reduced length of the lipstick housing 250, leading to overall compact design and light weight of the one-hand lipstick container 1.

FIGS. 31A, 31B, 31C, 31D, and 31E are a top plan view, a bottom plan view, a first cross-sectional view, a second cross-sectional view, and a perspective view, respectively, of the upper case 220.

In some embodiments, the upper case 220 may comprise an open-ended cylindrical tube defining an opening 221 at an upper end thereof. The upper case 220 may include a pair of projections 220*a* on opposite sides of an inner circumferential surface thereof, so as to interlock with an outer circumferential surface of the head 263 of the intermediate member 260.

FIGS. 32A, 32B, 32C, 32D, and 32E are a top plan view, a side elevational view, a bottom plan view, a cross-sectional view, and a perspective view, respectively, of the bottom case 200.

In some embodiments, the bottom case 200 may comprise a bottomed cylinder. The bottom case 200 may include projections 201 on an inner circumferential surface thereof, so as to interlock with an outer circumferential surface of the cylindrical main body 210. The projections 201 may include a plurality of vertical projections 201 intermittently disposed along the circumference of the bottom case 200. Alternatively, instead, the projections 201 may include a combination of horizontally aligned projections 201*a* and a plurality of vertical projections 201*b* intermittently disposed along the circumference of the bottom case 200, as depicted in FIGS. 32A through 32E.

Figure 33A:
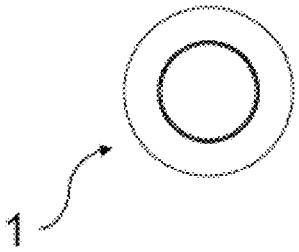
FIGS. 33A, 33B, and 33C are a top plan view, a side elevational view, and a perspective view, respectively, of the one-hand lipstick container of FIG. 20 in a fully closed state.
Figure 33B:
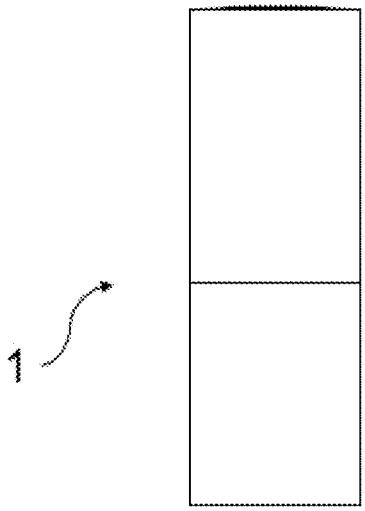
Figure 33C:
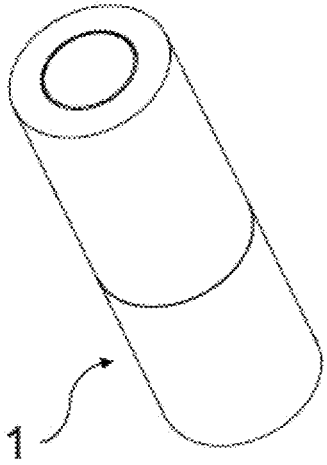
Figure 34:
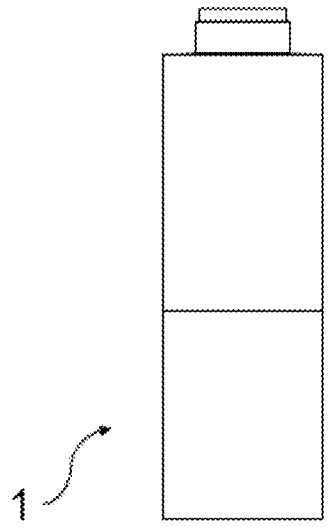
FIG. 34 is a side elevational view of the one-hand lipstick container of FIG. 20 in a fully open state.
Figure 35A:
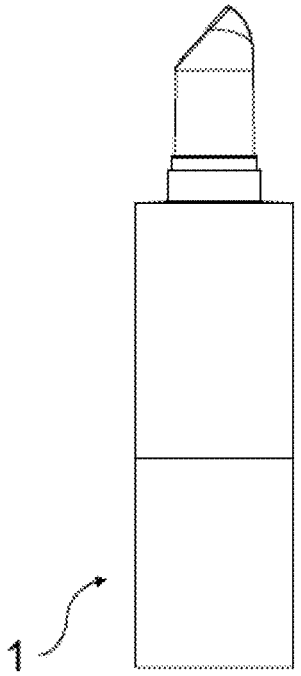
FIGS. 35A and 35B are a side elevational view and a perspective view, respectively, of the one-hand lipstick container of FIG. 20 in a fully open state, shown with a lipstick received therein.
Figure 35B:
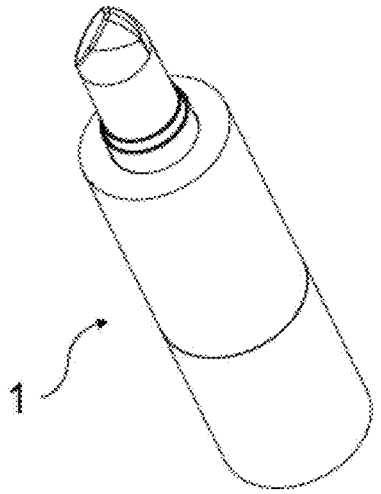

FIGS. 33A, 33B, and 33C are a top plan view, a side elevational view, and a perspective view, respectively, of the one-hand lipstick container 1 in a fully closed state. FIG. 34 is a side elevational view of the one-hand lipstick container 1 in a fully open state. FIGS. 35A and 35B are a side elevational view and a perspective view, respectively, of the one-hand lipstick container 1 in a fully open state, shown with a lipstick received therein.

Where the one-hand lipstick container 1 is in a fully closed state, the cover holder 230 is at its highest operational position whereas the lipstick housing 250 is at its lowest operational position. Applying a torque in a direction to open the one-hand lipstick container 1 (e.g., twisting the upper case 220 clockwise relative to the bottom case 2001 causes the cover holder 230 to move downward (i.e., descend) as the first protrusion 231 slides along the first helical guide groove 214, such that the cover 240 hinged to the cover holder 230 moves away from the opening 221 while guided along the cover guide groove 281 provided on the cover guide 280. Meanwhile, the same torque causes the lipstick housing 250 and the cylinder member 270 to move upward (i.e., ascend) as the second protrusion 253 and the third protrusion 270 slide along the second helical guide groove 216.

As the cover 240 is retracted from the opening 221 thereby exposing the inside of the one-hand lipstick container 1, the cylinder member 270 initially reaches the opening 221 whereas the lipstick housing 250 has its upper end still below the opening 221. Upward movement of the cylinder member 270 ceases once the cylinder member 270 reaches a predetermined height beyond the opening 221. Thereafter, the lipstick housing 250 continues upward movement until it reaches a predetermined height beyond the opening 221. The lipstick housing 250 may protrude beyond the cylinder member 270.

Where the one-hand lipstick container 1 is in a fully open state, the cover holder 230 is at its lowest operational position whereas the lipstick housing 250 is at its highest operational position. Applying a torque in a direction to close the one-hand lipstick container 1 (e.g., twisting the upper case 220 counterclockwise relative to the bottom case 200) causes the cover holder 230 to move upward (i.e., ascend) as the first protrusion 231 slides along the first helical guide groove 214, such that the cover 240 hinged to the cover holder 230 moves toward the opening 221 while guided along the cover guide groove 281 provided on the cover guide 280. Meanwhile, the same torque causes the lipstick housing 250 to move downward (i.e., descend) as the second protrusion 253 slides along the second helical guide groove 216, followed by the cylinder member 270 to move downward as the third protrusion 270 slides along the second helical guide groove 216.

As the cover 240 occupies the opening 221 thereby concealing the inside of the one-hand lipstick container 1, downward movement of the cylinder member 270 ceases once it reaches a predetermined height below the opening 221. Thereafter, the lipstick housing 250 continues downward movement until it reaches a predetermined height below the opening 221.

FIGS. 36A through 36H are diagrams schematically illustrating a method of producing a one-hand lipstick container 1 according to an embodiment of the present disclosure.

Figure 36A:
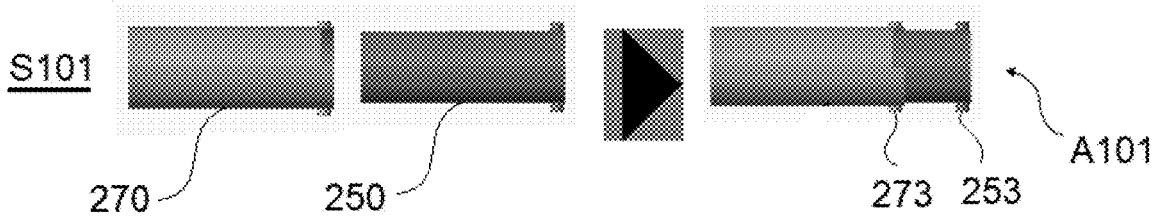
FIGS. 36A through 36H are diagrams schematically illustrating a method of producing one-hand lipstick container 1 according to an embodiment of the present disclosure.

As shown in FIG. 36A, in step S101, the cylinder member 270 and the lipstick housing 250 are combined by inserting the cylinder member 270 into the lipstick housing 250, so as to obtain a first subassembly A101 in which the cylinder member 270 telescopically surrounds the lipstick housing 250. In the first subassembly A101, the second pro Fusion 253 and the third pro Fusion 273 align with each other in the axial direction.

Figure 36B:
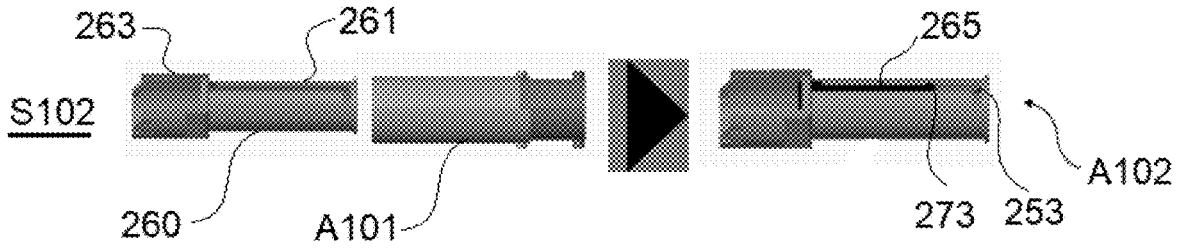

As shown in FIG. 36B, in step S102, the intermediate member 260 including the head 263 and the guide sleeve 261 is combined with the first subassembly A101 by inserting the first subassembly A101 into the intermediate member 260, so as to obtain a second subassembly A102 in which the intermediate member 260 is located radially outward from the cylinder member 270 and the lipstick housing 250. In the second subassembly A102, the second protrusion 253 and the third protrusion 273 protrude outward through the first guide slot 265 provided in the guide sleeve 261.

Figure 36C:
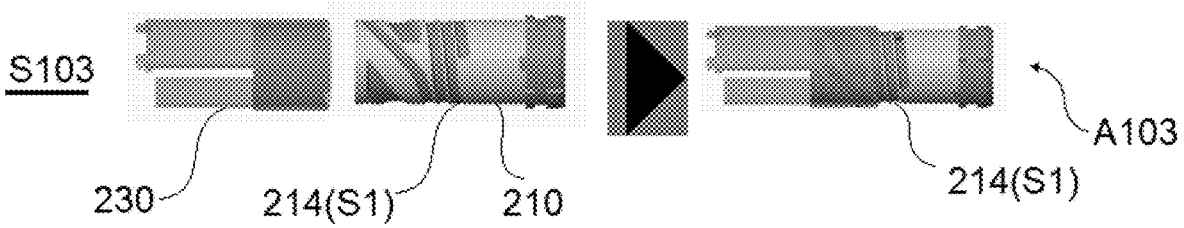

As shown in FIG. 36C, in step S103, the cover holder 230 and the cylindrical main body 210 are combined by fitting the cylindrical main body 210 into a bottom end of the cover holder 230, so as to obtain a third subassembly A103. In the third subassembly A103, the first protrusion 231 provided on the inner circumferential surface of the cover holder 230 slidably engages with the first helical guide groove 214 on the outer circumferential surface of the cylindrical main body 210.

Figure 36D:
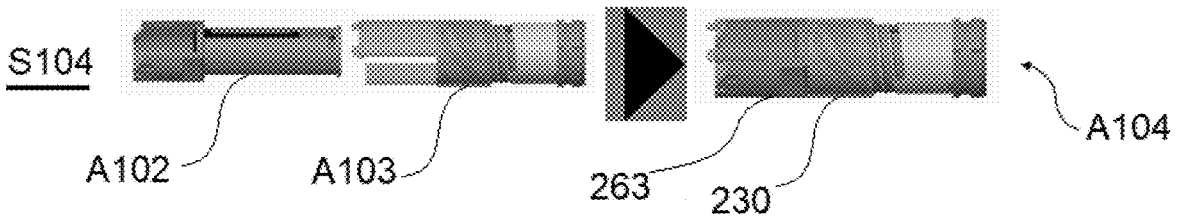

As shown in FIG. 36D, in step S104, the second subassembly A102 and the third subassembly A103 are combined by inserting the second subassembly A102 into the third subassembly A103, so as to obtain a fourth subassembly A104. In the fourth subassembly A104, the second protrusion 253 and the third protrusion 273 slidably engage with the second helical guide groove 216 provided on the inner circumferential surface of the cylindrical main body 210. The head 263 of the intermediate member 260 is exposed outside while fitting with the cover holder 230.

Figure 36E:
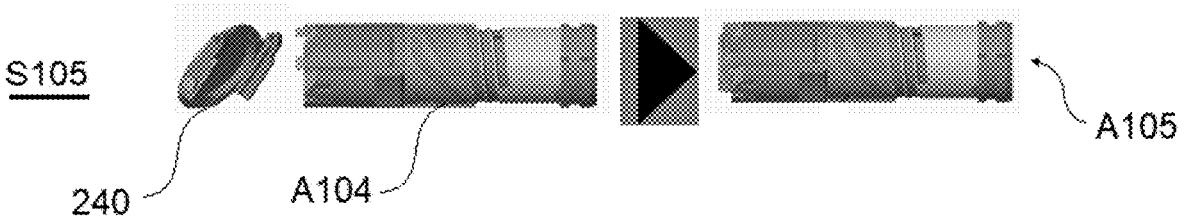

As shown in FIG. 36E, in step S105, the cover 240 is combined with the fourth subassembly A104 so as to obtain a fifth subassembly A105. In the fifth subassembly A105, the cover 240 is attached to the cover holder 230, e.g., by fitting the pins 230*a* provided on the cover holder 230 into the holes 242*a* of the cover 240.

Figure 36F:
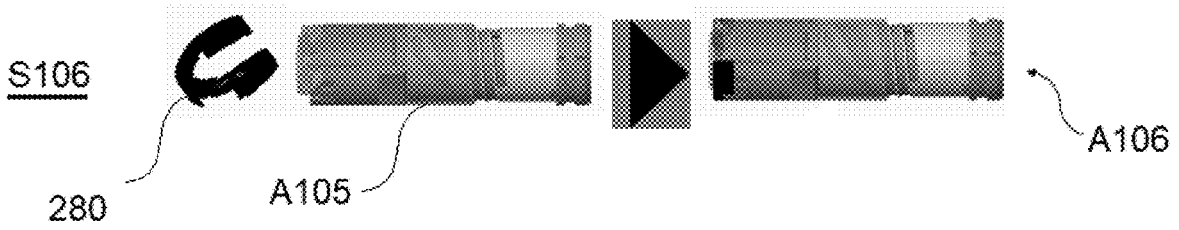

As shown in FIG. 36F, in step S106, the cover guide 280 is combined with the fifth subassembly A105, so as to obtain a sixth subassembly A106. In the sixth subassembly A106, the cover guide 280 is attached to the head 263 of the intermediate member 260, e.g., by fitting the recesses 263*c* on the outer circumference of the head 263 with the complementary projections 280*a* on the cover guide 280.

Figure 36G:
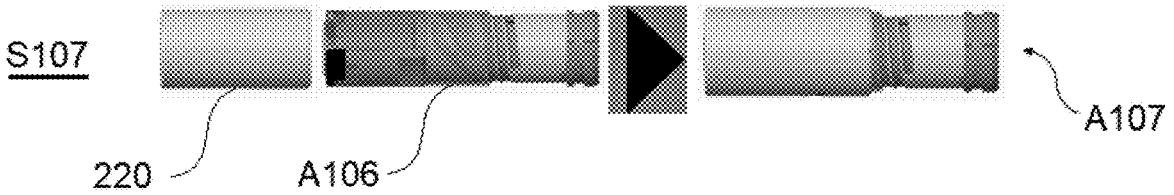

As shown in FIG. 36G, in step S107, the upper case 220 is combined with the sixth subassembly A106 by inserting an upper portion of the sixth subassembly A106 into the upper case 220, so as to obtain a seventh subassembly A107. In the seventh subassembly A107, the upper case 220 is affixed to the intermediate member 260, e.g., by fitting the horizontal grooves 263*d* provided on opposite sides of the outer circumferential surface of the head 263 with the projections 220*a* provided on opposite sides of the inner circumferential surface of the upper case 220.

Figure 36H:
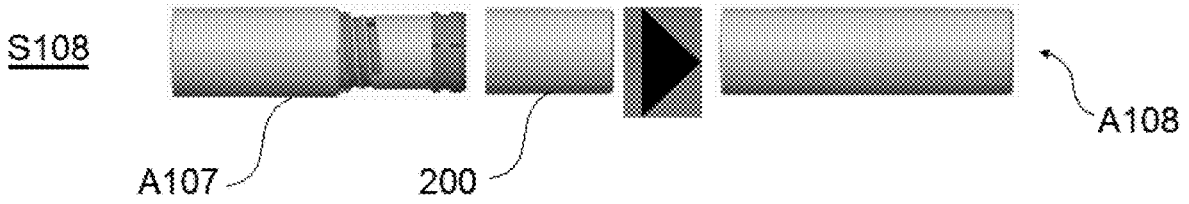

As shown in FIG. 36H, in step S108, the bottom case 200 is combined with the seventh subassembly A107 by inserting a lower portion of the seventh subassembly A107 into the bottom case 200, so as to obtain an eighth subassembly A108. In the eight subassembly A108, the bottom case 200 is affixed to the cylindrical main body 210, e.g., by fitting grooves provided on the outer circumferential surface of the cylindrical main body 210 with projections provided on the inner circumferential surface of the bottom case 200. Depending on particular applications, the eight Subassembly A108 may constitute a complete container 1 where no further process is performed.

In the method of producing the one-hand lipstick container 1 according to the present disclosure, the step of providing the cover guide 280 may be performed independently of the step of providing the upper case 220 and the step of providing the intermediate member 260. Further, the step of providing the cover guide 280 may be performed after the step of providing the cover 240.

Specifically, in the example depicted in FIGS. 36A to FIG. 36H, the step S106 of providing the cover guide 280 is performed independently of the step S107 of providing the upper case 220 and the step S102 of providing the intermediate member 260. Further, the step S106 of providing the cover guide 280 is performed after the step S105 of providing the cover 240.

Separating the step of providing the cover guide 280 from the steps of providing the upper case 220 and the intermediate member 260 as described herein may facilitate assembly of the one-hand lipstick container 1, wherein attachment of the cover 240 to the cover holder 230 and positioning of the cover 240 relative to the cover guide 280 may be performed without interfering with the surrounding structures, which ultimately results in unproved precision in the assembly, and consequently, high production yield and reliable performance of the resulting container 1.

It is to be understood that the present invention is not limited to the embodiments described above, and various modifications and alternative embodiments are possible without departing from the scope of the appended claims. For example, manufacturing methods include injection molding, 3D printing, and using various materials including metal. Accordingly, the present invention encompasses any and all embodiments derived from any such modifications and combinations of features within the scope of the appended claims.

The invention claimed is:

1. A one-hand lipstick container, comprising:

a cylindrical main body extending in an axial direction;

a cover holder rotatably received on an outer circumferential surface of the cylindrical main body via a first screw mechanism therebetween;

a cover hinged to the cover holder to open and close an opening at an upper end of the one-hand lipstick container;

a lipstick housing rotatably received on an inner circumferential surface of the cylindrical main body via a second screw mechanism therebetween, wherein the first screw mechanism and the second screw mechanism have opposite rotational directionalities to each other;

an intermediate member interposed radially between the cylindrical main body and the lipstick housing, the intermediate member including a head and a guide sleeve extending from the head, wherein the head slidably engages with the cover holder to limit rotation of the cover holder relative to the intermediate member while allowing the cover holder to move in the axial direction relative to the intermediate member, wherein the guide sleeve slidably engages with the lipstick housing to limit rotation of the lipstick housing relative to the intermediate member while allowing the lipstick housing to move in the axial direction relative to the intermediate member;

an upper case affixed to the intermediate member;

a bottom case affixed to the cylindrical main body; and a cover guide attached to the head of the intermediate member, the cover guide including a cover guide groove along which the cover is guided, wherein some of a plurality of recesses on the head of the intermediate member are aligned with and not inserted into some of a plurality of projections on the cover guide and one projection on the cover guide is inserted into one recess on the head of the intermediate member to secure the cover guide in place relative to the head of the intermediate member, and wherein a dimension of the cover guide is equal to or smaller than a gap between opposing surfaces of the upper case and the head of the intermediate member, such that the cover guide is fixed in place between the upper case and the head once the one-hand lipstick container is assembled.

2. The one-hand lipstick container according to claim 1, wherein the first screw mechanism includes:

a first helical guide groove provided on a threaded surface being one of the outer circumferential surface of the cylindrical main body and an inner circumferential surface of the cover holder; and a first protrusion provided on the other one of the outer circumferential surface of the cylindrical main body and the inner circumferential surface of the cover holder to slidably engage with the first helical guide groove; and an auxiliary guide groove disposed adjacent to an upper end of the first helical guide groove, wherein the auxiliary guide groove is separate from the first helical guide groove, and is configured to receive the first protrusion therein.

3. The one-hand lipstick container according to claim 2, wherein an upper end of the auxiliary guide groove tapers to a pointed tip, so as to restrict further movement of the first protrusion away from the upper end of the auxiliary guide groove in response to a torque applied in a direction to open the one-hand lipstick container.

4. The one-hand lipstick container according to claim 2, wherein a lower end of the auxiliary guide groove has a gradually reduced depth to be level with the threaded surface, so as to allow the first protrusion to exit the auxiliary guide groove to reengage with the first helical guide groove in response to a torque applied in a direction to close the one-hand lipstick container.

5. The one-hand lipstick container according to claim 2, wherein the auxiliary guide groove extends diagonally to the axial direction, so as to generally follow the contour of the first helical guide groove.

6. The one-hand lipstick container according to claim 1, further comprising:

a cylinder member telescopically surrounding the lipstick housing, wherein the guide sleeve slidably engages with the cylinder member to limit rotation of the cylinder member relative to the intermediate member while allowing the cylinder member to move in the axial direction relative to the intermediate member, wherein the second screw mechanism includes:

a second helical guide groove provided on the inner circumferential surface of the cylindrical main body;

a second protrusion provided on an outer circumferential surface of the lipstick housing to slidably engage with the second helical guide groove; and a third protrusion provided on an outer circumferential surface of the cylinder member to slidably engage with the second helical guide groove, wherein the guide sleeve includes a first guide slot extending in the axial direction, through which each of the second protrusion and the third protrusion protrudes outward to slidably engage with the second helical guide groove, and wherein the cylinder member includes a second guide slot extending upward from a bottom end of the cylinder member in the axial direction, through which the second protrusion protrudes outward to slidably engage with the second helical guide groove, and wherein an upper end of the second guide slot is located at the same level as the third protrusion in the axial direction.

7. The one-hand lipstick container according to claim 6, wherein the second guide slot includes:

a positioning portion located adjacent to the bottom end of the cylinder member and aligned with the third protrusion in the axial direction; and a guide portion extending from the positioning portion and terminating in the upper end of the second guide slot, the guide portion being offset from the third protrusion in the axial direction.

8. The one-hand lipstick container according to claim 6, the guide sleeve further includes:

a first horizontal slot continuous with an upper end of the first guide slot and offset from the first guide slot in the axial direction; and a second horizontal slot continuous with a lower end of the first guide slot and offset from the first guide slot in the axial direction, wherein the second horizontal slot extends horizontally in a direction opposite to the first horizontal slot.

9. The one-hand lipstick container according to claim 6, wherein the third protrusion is located higher than the second protrusion is in the axial direction, where the one-hand lipstick container is in a fully closed state, the third protrusion is located at the same level as the second protrusion is in the axial direction, where the one-hand lipstick container is in a fully open state, a distance between the second protrusion and the third protrusion in the axial direction diminishes as the one-hand lipstick container is operated from the fully closed state to the fully open state.

10. The one-hand lipstick container according to claim 1, wherein the head of the intermediate member has an outer circumferential surface thereof configured to interlock with an inner circumferential surface of the upper case.

11. The one-hand lipstick container according to claim 1, wherein the cover holder includes:

an annular base;

a first sliding part extending from the annular base; and a second sliding part extending from the annular base, disposed radially opposite the first sliding part, wherein the head of the intermediate member includes:

a first vertical guide portion configured to receive the first sliding part of the cover holder slidably therealong in the axial direction; and a second vertical guide portion, disposed opposite the first vertical guide portion, configured to receive the second vertical guide portion of the cover holder slidably therealong in the axial direction.

12. A method of producing a one-hand lipstick container, the method comprising the steps of:

providing a cylindrical main body extending in an axial direction;

providing a cover holder rotatably received on an outer circumferential surface of the cylindrical main body via a first screw mechanism therebetween;

providing a cover hinged to the cover holder to open and close an opening at an upper end of the one-hand lipstick container;

providing a lipstick housing rotatably received on an inner circumferential surface of the cylindrical main body via a second screw mechanism therebetween, wherein the first screw mechanism and the second screw mechanism have opposite rotational directionalities to each other;

providing an intermediate member interposed radially between the cylindrical main body and the lipstick housing, the intermediate member including a head and a guide sleeve extending from the head, wherein the head slidably engages with the cover holder to limit rotation of the cover holder relative to the intermediate member while allowing the cover holder to move in the axial direction relative to the intermediate member, wherein the guide sleeve slidably engages with the lipstick housing to limit rotation of the lipstick housing relative to the intermediate member while allowing the lipstick housing to move in the axial direction relative to the intermediate member;

providing an upper case affixed to the intermediate member;

providing a bottom case affixed to the cylindrical main body;

providing a cover guide attached to the head of the intermediate member, the cover guide including a cover guide groove along which the cover is guided; and providing a plurality of recesses on the head of the intermediate member and a plurality of projections on the cover guide so that some of the plurality of recesses are aligned with and not inserted into some of the plurality of projections and one projection is inserted into one recess to secure the cover guide in place relative to the head of the intermediate member, wherein a dimension of the cover guide is equal to or smaller than a gap between opposing surfaces of the upper case and the head of the intermediate member, such that the cover guide is fixed in place between the upper case and the head once the one-hand lipstick container is assembled.

13. The method of producing a one-hand lipstick container according to claim 12, wherein the step of providing the cover guide is performed independently of the step of providing the upper case and the step of providing the intermediate member.

14. The method of producing a one-hand lipstick container according to claim 12, wherein the step of providing the cover guide is performed after the step of providing the cover.

15. An internal assembly for a one-hand lipstick container, the internal assembly comprising:

a cylindrical main body extending in an axial direction;

a cover holder rotatably received on an outer circumferential surface of the cylindrical main body via a first screw mechanism therebetween;

a cover hinged to the cover holder to open and close an opening at an upper end of the one-hand lipstick container;

a lipstick housing rotatably received on an inner circumferential surface of the cylindrical main body via a second screw mechanism therebetween, wherein the first screw mechanism and the second screw mechanism have opposite rotational directionalities to each other;

an intermediate member interposed radially between the cylindrical main body and the lipstick housing, the intermediate member including a head and a guide sleeve extending from the head, wherein the head slidably engages with the cover holder to limit rotation of the cover holder relative to the intermediate member while allowing the cover holder to move in the axial direction relative to the intermediate member, wherein the guide sleeve slidably engages with the lipstick housing to limit rotation of the lipstick housing relative to the intermediate member while allowing the lipstick housing to move in the axial direction relative to the intermediate member; and a cover guide attached to the head of the intermediate member, the cover guide including a cover guide groove along which the cover is guided, wherein some of a plurality of recesses on the head of the intermediate member are aligned with and not inserted into some of a plurality of projections on the cover guide and one projection on the cover guide is inserted into one recess on the head of the intermediate member to secure the cover guide in place relative to the head of the intermediate member, and wherein a dimension of the cover guide is equal to or smaller than a gap between opposing surfaces of the upper case and the head of the intermediate member, such that the cover guide is fixed in place between the upper case and the head once the one-hand lipstick container is assembled.

* * * * *